US011376723B2

(12) United States Patent
Kameda et al.

(10) Patent No.: US 11,376,723 B2
(45) Date of Patent: Jul. 5, 2022

(54) STAPLER

(71) Applicant: MAX CO., LTD., Tokyo (JP)

(72) Inventors: Futoshi Kameda, Tokyo (JP); Kazuhiko Kishi, Tokyo (JP); Yutaka Oshima, Tokyo (JP)

(73) Assignee: MAX CO., LTD., Tokyo (JP)

( * ) Notice: Subject to any disclaimer, the term of this patent is extended or adjusted under 35 U.S.C. 154(b) by 276 days.

(21) Appl. No.: 16/671,589

(22) Filed: Nov. 1, 2019

(65) Prior Publication Data

US 2020/0139528 A1 May 7, 2020

(30) Foreign Application Priority Data

Nov. 2, 2018 (JP) ..... JP2018-207723

(51) Int. Cl.
*B25C 5/02* (2006.01)
*B27F 7/19* (2006.01)

(52) U.S. Cl.
CPC ..... *B25C 5/0207* (2013.01); *B27F 7/19* (2013.01)

(58) Field of Classification Search
CPC ..... B25C 5/00; B25C 5/02; B25C 5/0207; B25C 5/0221; B25C 5/0228; B25C 5/0264; B25C 5/0271; B25C 5/0278; B25C 5/04; B25C 5/15
USPC ..... 227/7, 129, 131, 155
See application file for complete search history.

(56) References Cited

U.S. PATENT DOCUMENTS 3,414,024 A * 12/1968 Anderson ..... H05K 13/0473 140/1
6,036,074 A * 3/2000 Manabe ..... B27F 7/19 227/155
6,250,531 B1 * 6/2001 Yagi ..... B27F 7/19 227/79
9,987,734 B2 * 6/2018 Marks ..... B25C 5/15
2001/0050302 A1 * 12/2001 Hakozaki ..... B27F 7/21 227/155
2003/0000992 A1 * 1/2003 Borjesson ..... B27F 7/19 227/155

(Continued)

FOREIGN PATENT DOCUMENTS

EP 0995561 A2 4/2000
JP 2018-69636 A 5/2018

OTHER PUBLICATIONS

The Extended European Search Report mailed in corresponding EP Patent Application No. 19206581.1 dated May 6, 2020 (6 pages).

*Primary Examiner* — Andrew M Tecco
*Assistant Examiner* — Jacob A Smith
(74) *Attorney, Agent, or Firm* — Weihrouch IP

(57) ABSTRACT

A stapler includes a striking part which causes a pair of staple legs to penetrate a sheet bundle, a bending part which bends the staple legs at a first position such that tips of the staple legs are directed inwardly, and a clincher part which bends the staple legs at a second position located closer to the sheet bundle than the first position to be entirely directed inwardly. The bending part includes a first part disposed on an inner side of the staple legs and having a first tip portion facing the staple legs at the first position, a second part disposed on an outer side of the staple legs and having a second tip portion facing the staple legs on a non-sheet bundle side than the first position, and a moving part which moves at least one of the first and second parts toward the staple legs.

8 Claims, 24 Drawing Sheets

(56) References Cited

U.S. PATENT DOCUMENTS

| | | | | |
|---|---|---|---|---|
| 2006/0043146 | A1* | 3/2006 | Oide | B27F 7/19 227/155 |
| 2008/0093409 | A1* | 4/2008 | Sugihara | B27F 7/21 227/108 |
| 2008/0135599 | A1* | 6/2008 | Kishi | B27F 7/19 227/76 |
| 2010/0096430 | A1* | 4/2010 | Sugihara | B27F 7/19 227/155 |
| 2018/0117749 | A1* | 5/2018 | Shimizu | B27F 7/19 |
| 2018/0117787 | A1* | 5/2018 | Shimizu | B25C 5/0207 |

* cited by examiner

STAPLER

CROSS-REFERENCE TO RELATED APPLICATIONS

This application is based upon and claims the benefit of priority from prior Japanese patent application No. 2018-207723, filed on Nov. 2, 2018, the entire contents of which are incorporated herein by reference.

TECHNICAL FIELD

Aspects of the present invention relate to a stapler configured to bind a sheet bundle of a plurality of sheets by a staple.

BACKGROUND ART

A stapler is configured to cause a pair of staple legs of a staple to penetrate a sheet bundle and to bind the sheet bundle by bending the pair of staple legs having penetrated the sheet bundle with a clincher part (for example, refer to JP-A-2018-69636). The clincher part includes a pair of clinchers configured to move along a surface direction of the sheet bundle so as to approach each other. When the clinchers are moved from an outer side of the staple legs, as described above, the staple legs are bent inwardly along a surface (also referred to as "sheet surface") of the sheet bundle.

Since the staple legs bent by the pair of clinchers are linearly bent along the sheet surface, when the clinching (the bending of the staple legs) is not sufficiently performed upon the binding of the sheet bundle, the staple legs, particularly, the staple leg tips are likely to separate and float from the sheet surface.

SUMMARY

Accordingly, an aspect of the present invention provides a stapler capable of making it difficult for a tip of a staple leg having bound a sheet bundle to separate and float from a sheet surface.

According to an exemplary embodiment of the present invention, there is provided a stapler including: a striking part configured to cause a pair of staple legs to penetrate a sheet bundle; a bending part configured to bend the staple legs at a first position such that tips of the staple legs having penetrated the sheet bundle by the striking part are directed inwardly; and a clincher part configured to bend the staple legs at a second position located closer to the sheet bundle than the first position such that the staple legs of which the tips are bent inwardly at the first position by the bending part are entirely directed inwardly, wherein the bending part includes: a first part disposed on an inner side of the pair of staple legs and having a first tip portion facing the staple legs and located at the first position; a second part disposed on an outer side of the pair of staple legs and having a second tip portion facing the staple legs and located on a non-sheet bundle side spaced from the sheet bundle further than the first position; and a moving part configured to move at least one of the first part and the second part toward the staple legs.

The first part is disposed on the inner side of the pair of staple legs, and the first tip portion facing the staple legs is located at the first position of the staple legs. Also, the second part is disposed on the outer side of the pair of staple legs, and the second tip portion facing the staple legs is located on the non-sheet bundle side further than the first position. Therefore, when at least one of the first part and the second part is moved toward the staple legs by the moving part, the staple leg tips are bent inwardly about the first position as a support point by the first part and the second part. Then, when the entire staple legs of which the tips are bent inwardly about the first position as a support point are bent with the clincher part, the tips are directed toward the sheet bundle from the first position of the staple legs having bound the sheet bundle. For this reason, even when the staple legs are floated from the sheet surface, the staple leg tips are directed toward the sheet bundle.

According to the above stapler, the tip of the staple leg having bound the sheet bundle is difficult to separate and float from the sheet surface.

DESCRIPTION OF EMBODIMENTS

Hereinbelow, exemplary embodiments of the present disclosure will be described with reference to the drawings.

<Configuration Example of Image Forming System and Post Processing Apparatus>

Figure 1:
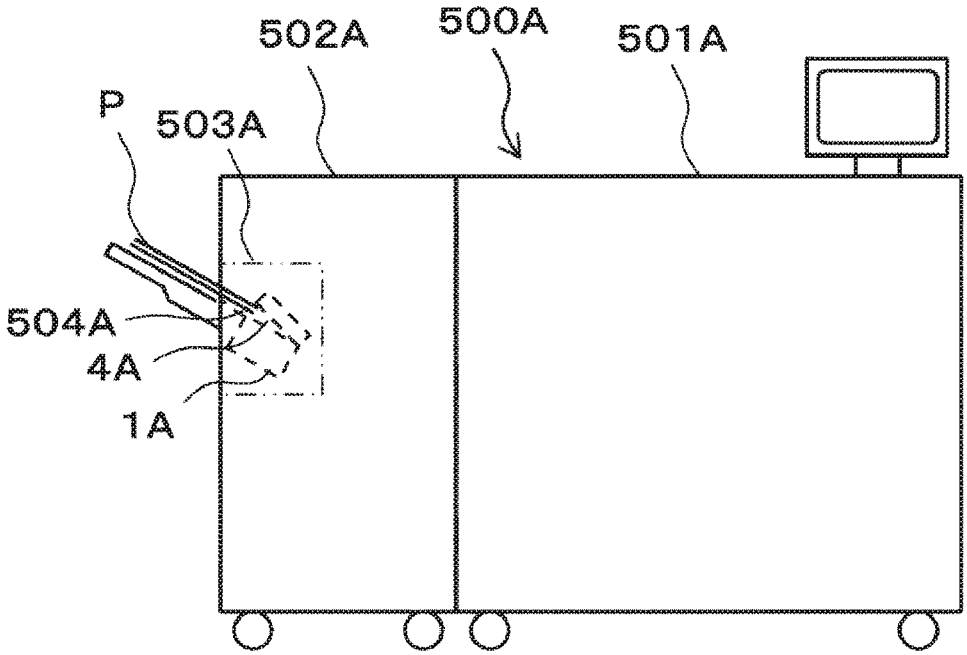
FIG. 1 is a configuration view illustrating an outline of an image forming system of an exemplary embodiment.

FIG. 1 is a configuration view illustrating an outline of an image forming system of an exemplary embodiment.

An image forming system 500A of the exemplary embodiment includes an image forming apparatus 501A and a post processing apparatus 502A capable of performing at least one type of processing. The image forming apparatus 501A is configured to form an image on a sheet fed from a feeder part (not shown) inside or outside the apparatus and to output the sheet. In the present example, the image forming apparatus 501A is configured to form an image on a sheet by formation of an electrostatic latent image by scanning and exposure, developing of the electrostatic latent image by toner, and transfer and fixing of the toner onto the sheet.

The post processing apparatus 502A includes a binding part 503A. The binding part 503A includes a stapler 1A and a stacking part 504A on which a sheet bundle P of the overlapping sheets output from the image forming apparatus 501A is stacked.

<Configuration Example of Stapler of Exemplary Embodiment>

Figure 2A:
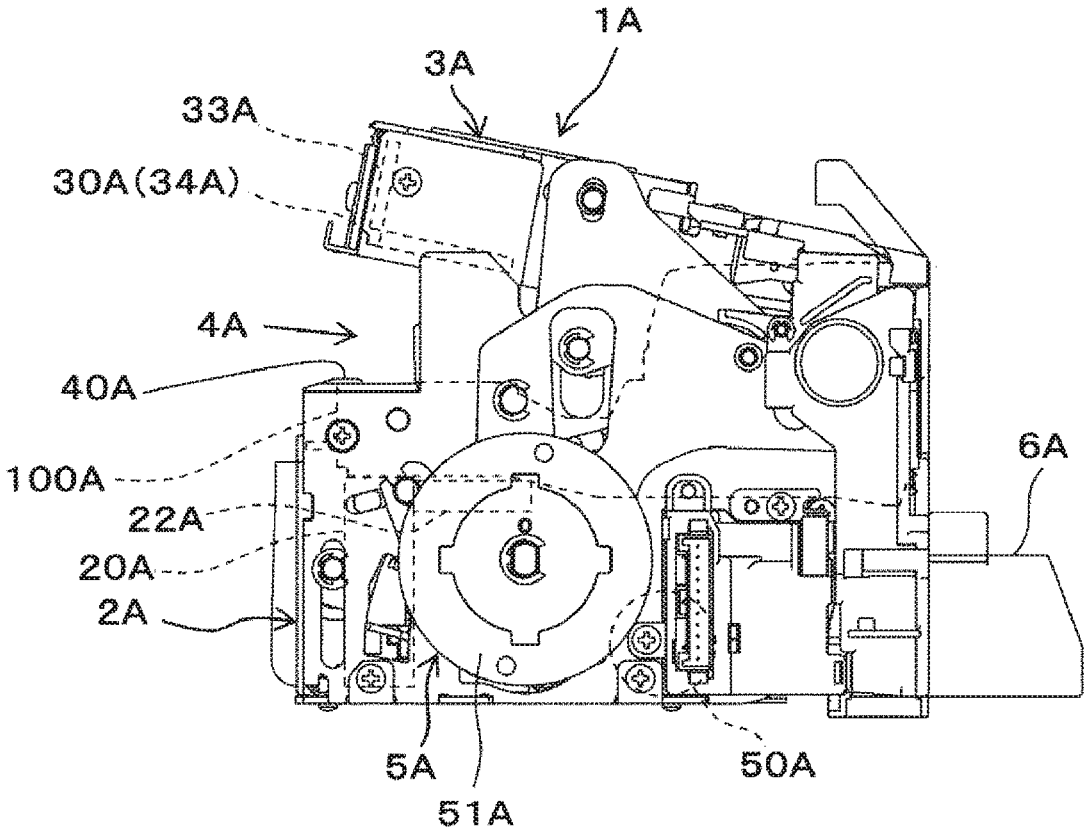
FIG. 2A is a side view illustrating a stapler of the exemplary embodiment.
Figure 2B:
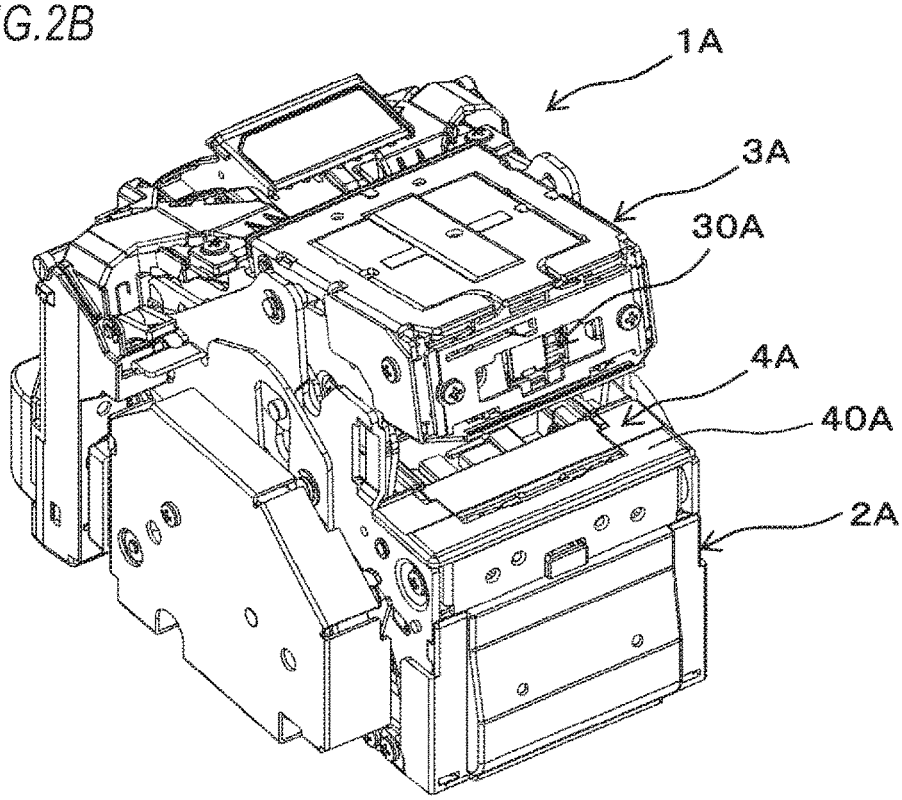
FIG. 2B is a perspective view illustrating the stapler of the exemplary embodiment.
Figure 2C:
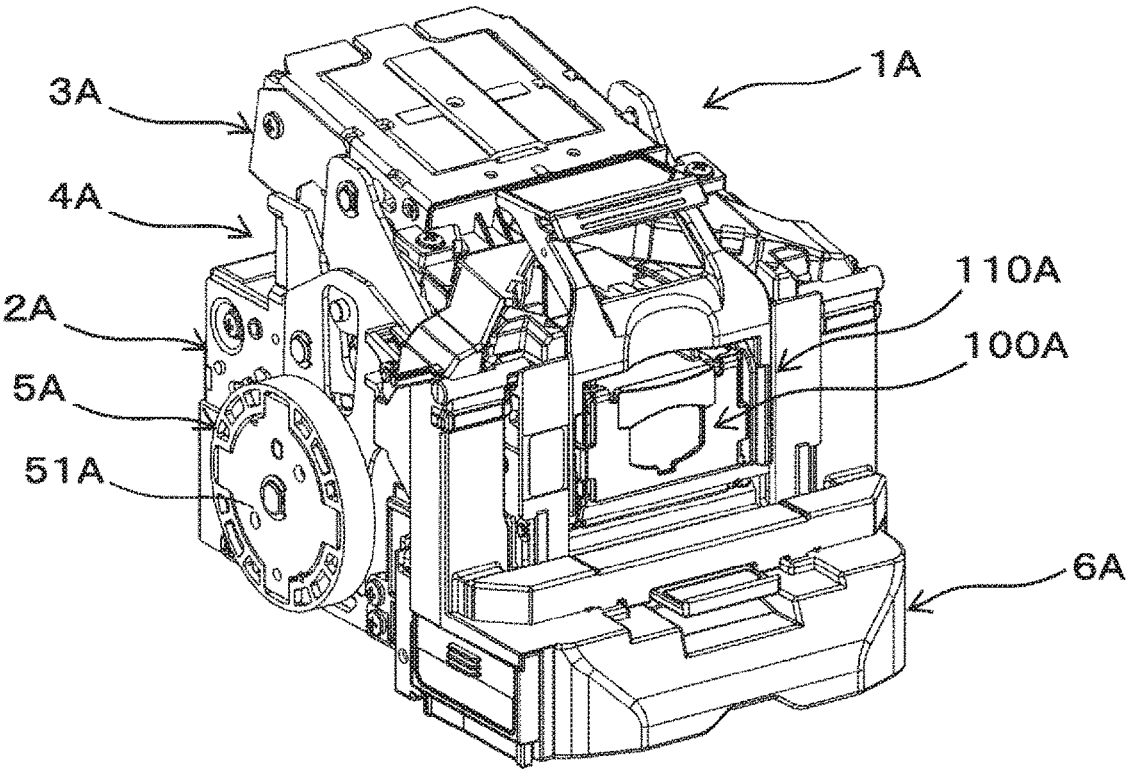
FIG. 2C is a perspective view illustrating the stapler of the exemplary embodiment.
Figure 3A:
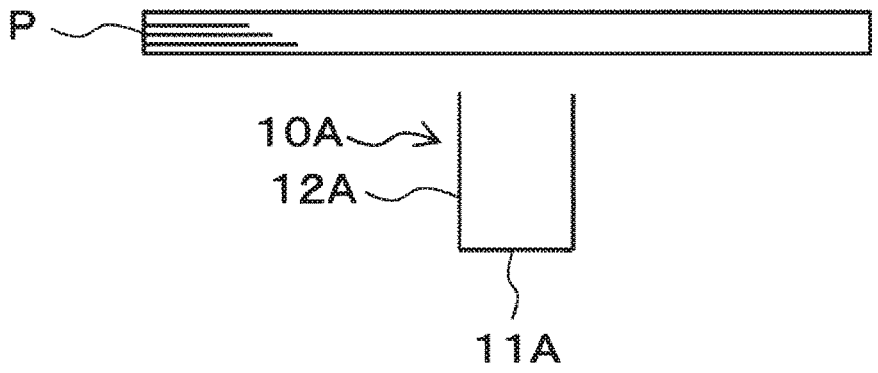
FIG. 3A illustrates an example of an operation of binding sheets with a staple.
Figure 4:
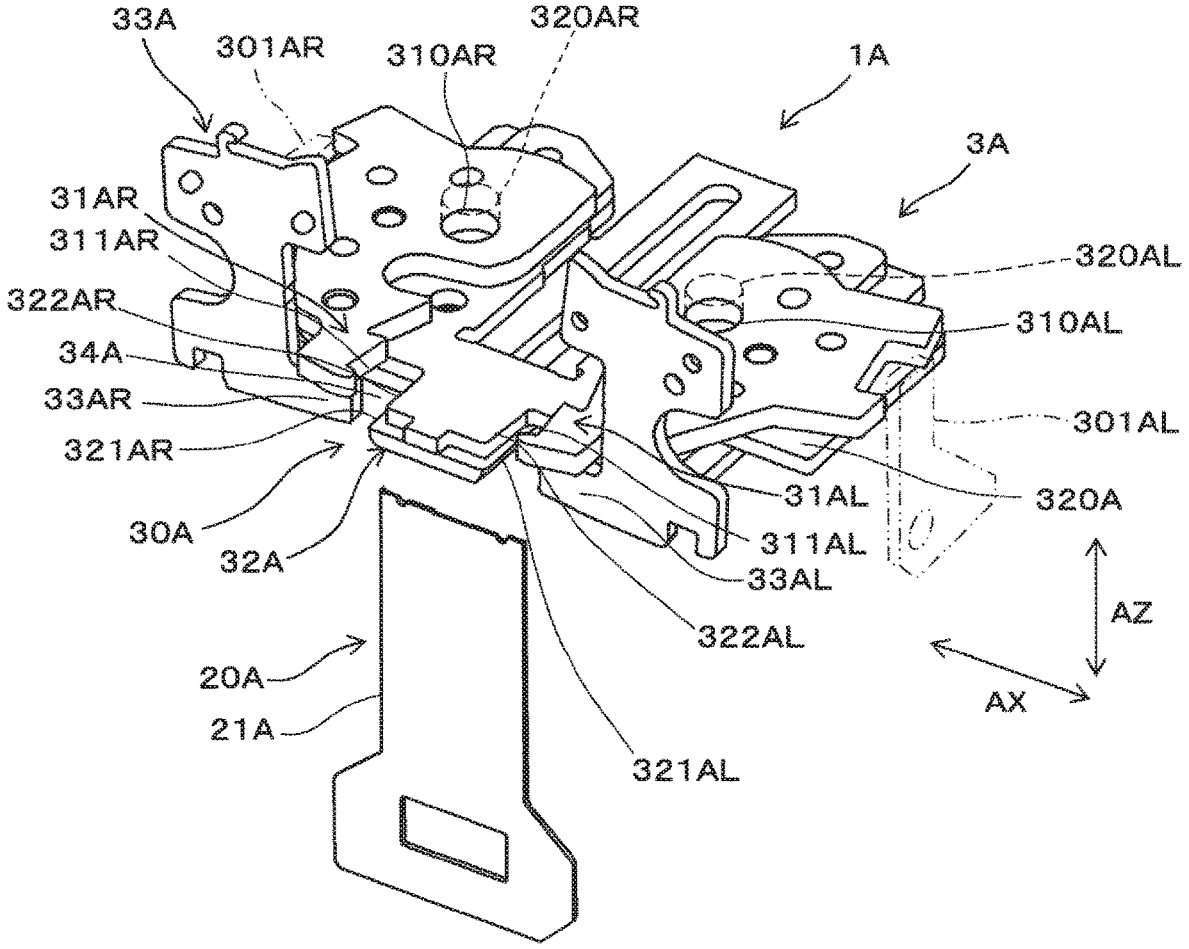
FIG. 4 is a perspective view illustrating a configuration of parts of the stapler of the exemplary embodiment.
Figure 5:
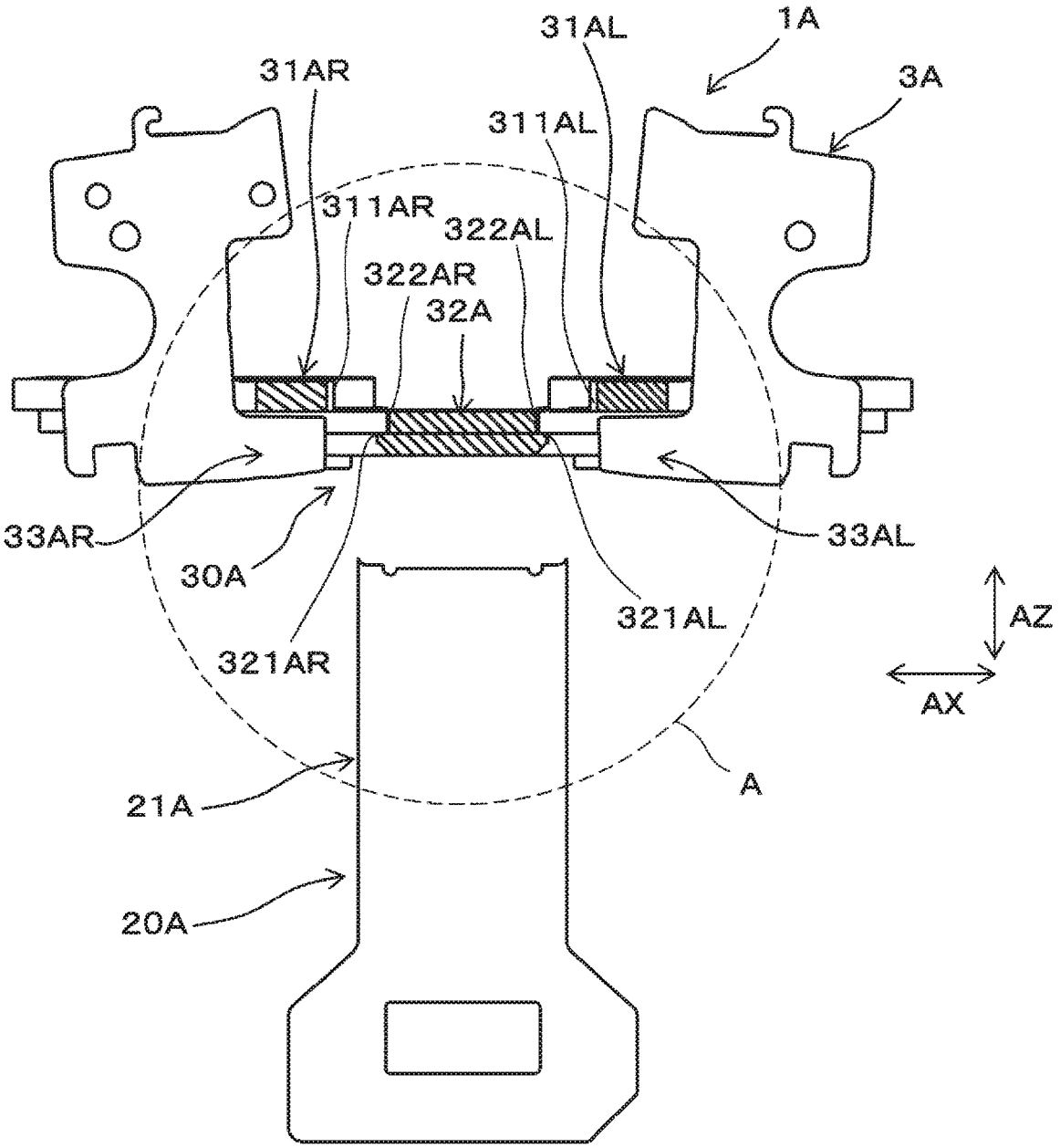
FIG. 5 is a front view illustrating the configuration of parts of the stapler of the exemplary embodiment.
Figure 6:
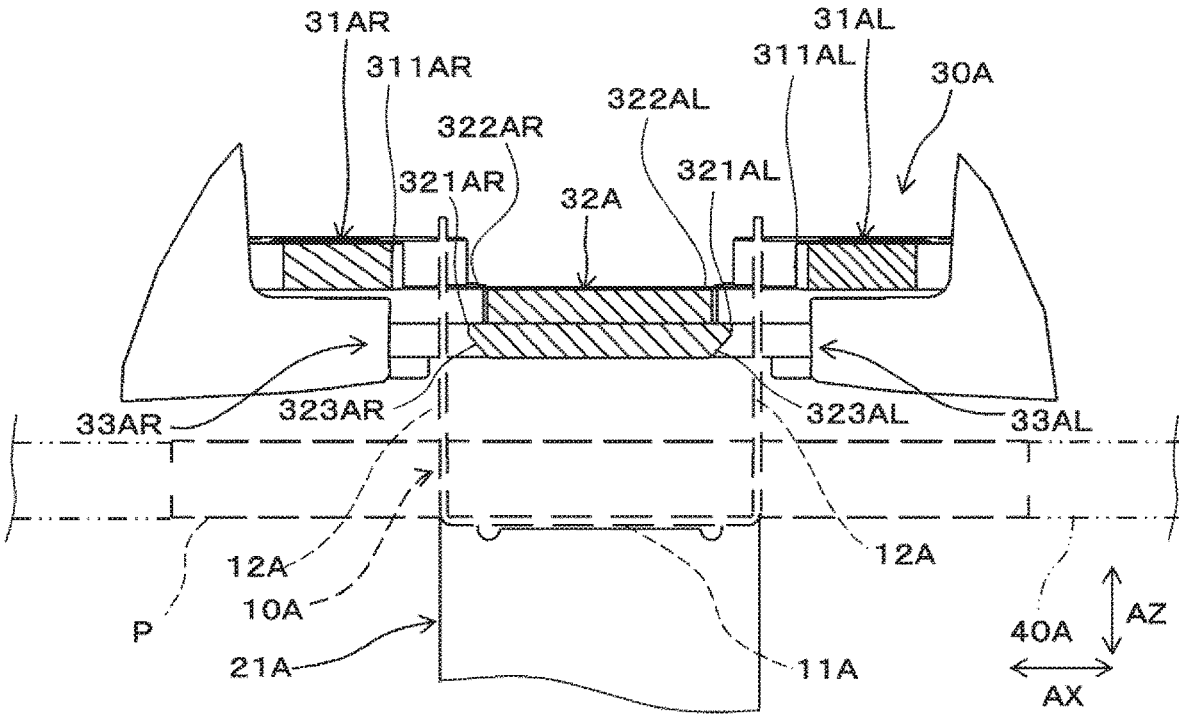
FIG. 6 is an enlarged view of an A part in FIG. 5.

FIG. 2A is a side view illustrating the stapler 1A of the exemplary embodiment, and FIGS. 2B and 2C are perspective views illustrating the stapler of the exemplary embodiment. FIGS. 3A to 3E illustrate an operation of binding sheets with a staple. FIG. 4 is a perspective view illustrating a configuration of parts of the stapler of the exemplary embodiment. FIG. 5 is a front view illustrating the configuration of parts of the stapler of the exemplary embodiment. FIG. 6 is an enlarged view of an A part in FIG. 5.

First, an outline of an operation of binding the sheet bundle P with the stapler 1A is described with reference to FIGS. 3A to 3E. As shown in FIG. 3A, a staple 10A has staple legs 12A formed by bending both ends of a crown portion 11A in one direction.

Figure 3B:
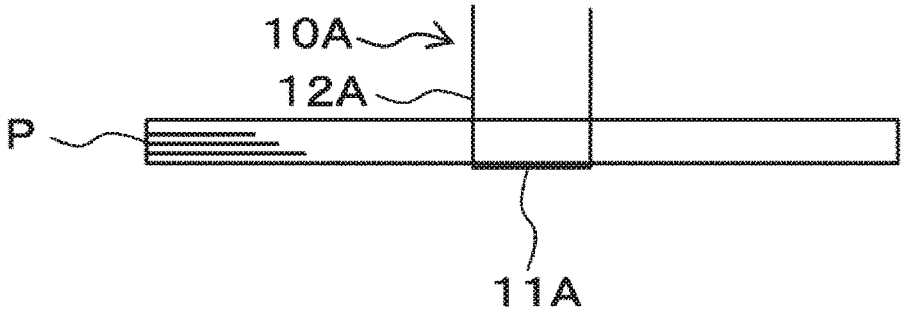
FIG. 3B illustrates an example of the operation of binding sheets with the staple.

The crown portion 11A of the staple 10A is pressed, so that the staple legs 12A are caused to penetrate the sheet bundle P, as shown in FIG. 3B. In a state where the staple legs 12A penetrate the sheet bundle P up to a position in which the crown portion 11A is in contact with the sheet bundle P, when lengths of the staple legs 12A protruding from the sheet bundle P exceeds a half of a length of the crown portion 11A, the staple legs 12A are overlapped with each other as a result of bending the staple legs 12A toward each other.

Figure 3C:
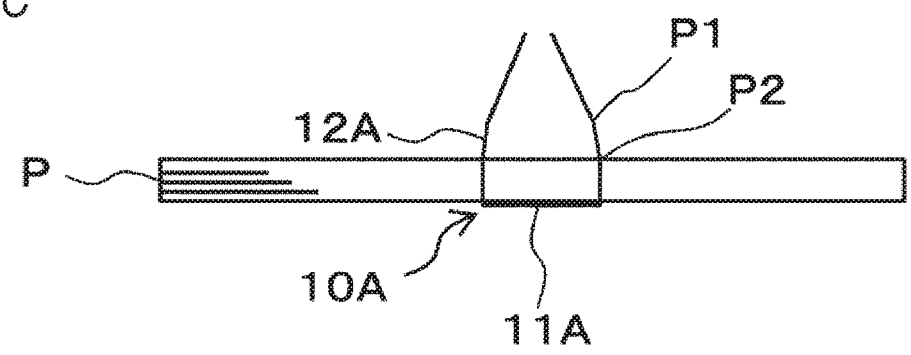
FIG. 3C illustrates an example of the operation of binding sheets with the staple.
Figure 3D:
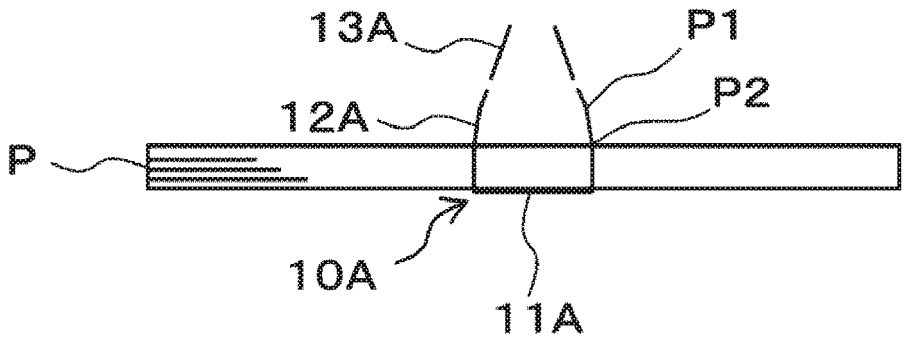
FIG. 3D illustrates an example of the operation of binding sheets with the staple.

At this time, extra portions of the staple legs 12A overlapped with each other when bending the staple legs 12A are cut. In the exemplary embodiment, in a process of cutting the extra portions of the staple legs 12A, before cutting the extra portions of the staple legs 12A, the pair of staple legs 12A having penetrated the sheet bundle P is respectively bent inwardly at a first position P1, as shown in FIG. 3C. Then, as shown in FIG. 3D, predetermined positions of further tip sides of the staple legs 12A than the first position P1 are cut as cut staples 13A. Whether the extra portions of the staple legs 12A occur is determined based on a sheet thickness and a number of sheets of the sheet bundle P to be bound with the staple 10A, for example.

Figure 3E:
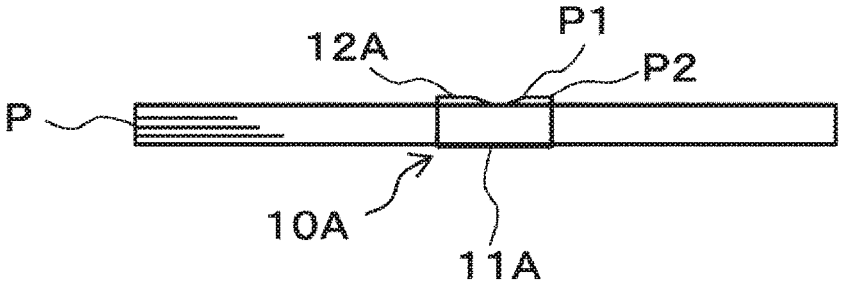
FIG. 3E illustrates an example of the operation of binding sheets with the staple.

The staple 10A of which the staple legs 12A are cut into predetermined lengths binds the sheet bundle P as the staple legs 12A having penetrated the sheet bundle P are bent further inwardly at a second position P2 located on a substantial upper surface of the sheet bundle P, as shown in FIG. 3E.

As shown in FIGS. 2A, 2B, 2C, 4, 5 and 6, the stapler 1A includes a striking unit 2A configured to supply the staple 10A and to strike out the staple 10A toward the sheet bundle P, and a binding unit 3A configured to cut and bend the staple legs 12A of the staple 10A struck out by the striking unit 2A. Also, the stapler 1A includes a sheet sandwiching part 4A for sandwiching the sheet bundle P between the striking unit 2A and the binding unit 3A.

In descriptions below, a side on which the sheet sandwiching part 4A is provided is referred to as a front side of the stapler 1A, and an opposite side to the side on which the sheet sandwiching part 4A is provided is referred to as a rear side. Also, a side on which the binding unit 3A is provided is referred to as an upper side of the stapler 1A, and a side on which the striking unit 2A is provided is referred to as a lower side of the stapler 1A.

The striking unit 2A includes a placement part 40A on which the sheet bundle P can be placed, a cartridge accommodation part 110A located on a lower rear side of the placement part 40A and capable of accommodating a staple cartridge 100A in which a plurality of staple sheets (not shown) (obtained by coupling linear staples into a sheet shape) is stacked, a conveyor part 22A configured to convey forward the staple sheet accommodated in the cartridge accommodation part 110A and to expose one staple located at at least a forefront of the staple sheet from a front end face of the staple cartridge 100A, a forming part configured to form the linear staple exposed from the front end face of the staple cartridge 100A into a substantial U-shape, and a striking part 20A disposed to strike out the U-shaped staple 10A toward the sheet sandwiching part 4A.

The staple cartridge 100A is detachably attached to the cartridge accommodation part 110A.

The binding unit 3A includes a cutting part 34A capable of cutting the staple legs 12A of the staple 10A having penetrated the sheet bundle P, and a clincher part 33A configured to bend the staple legs 12A of the staple 10A having penetrated the sheet bundle P inwardly, i.e., toward the sheet bundle P.

The sheet sandwiching part 4A is a space formed between the placement part 40A of the striking unit 2A and the clincher part 33A of the binding unit 3A, and has a shape opening in three directions of the front side and left and right sides of the stapler 1A. When binding the sheet bundle P by the stapler 1A, the sheet bundle is inserted into the sheet sandwiching part 4A, and the sheet bundle P is placed on the placement part 40A of the striking unit 2A.

The striking unit 2A includes a drive part 5A for vertically moving (opening and closing) the binding unit 3A relative to the striking unit 2A. The drive part 5A includes a motor 50A, a cam 51A configured to rotate by drive of the motor 50A, a link (not shown) configured to transmit an operation of the cam 51A to the respective parts, and the like. The binding unit is connected to the link and is configured to move downward by rotation of the cam.

Also, the stapler 1A includes a detachable cut staple storing part 6A provided on the rear side and configured to store the cut staples 13A cut by the cutting part 34A.

The operation of the cam 51A is transmitted to the binding unit 3A via the link and the like, so that the binding unit 3A is moved away from and toward the striking unit 2A. While the cam 51A rotates in one direction, the binding unit 3A is moved toward the striking unit 2A, thereby sandwiching the sheet bundle P placed on the placement part 40A at predetermined timing by the sheet sandwiching part 4A. While the cam 51A further rotates in one direction, the binding unit 3A is moved away from the striking unit 2A at predetermined timing, thereby releasing the sheet bundle P sandwiched by the sheet sandwiching part 4A.

While the cam 51A rotates in one direction after the sheet bundle P placed on the placement part 40A is sandwiched by the sheet sandwiching part 4A, the striking unit 2A strikes one staple 10A at the forefront into the sheet bundle P sandwiched with the sheet sandwiching part 4A, thereby causing the staple legs 12A of the staple 10A to penetrate the sheet bundle P. Also, a second or third linear staple following the forefront is formed into a substantial U-shape in the forming part (not shown).

While the operation of the cam 51A is transmitted via the link and the like and the cam 51A rotates in one direction, the binding unit 3A bends and cuts the staple legs 12A of the staple 10A having penetrated the sheet bundle P at the first position P1 and bends the staple legs 12A at the second position P2.

The striking part 20A includes a striking member 21A configured to press the crown portion 11A of the staple 10A and to strike out the same toward the binding unit 3A. The striking member 21A is provided at a position facing the crown portion 11A in a striking direction of the staple 10A toward the sheet bundle P, and is configured to be movable in the striking direction toward the crown portion 11A and the sheet bundle P. In a state where the staple 10A is set at a binding position of the sheet bundle P, the striking member 21A moves in the striking direction to press the crown portion 11A, so that the staple legs 12A are caused to penetrate the sheet bundle P.

In the vicinity of the staple legs 12A having penetrated the sheet bundle P, a bending part 30A configured to bend portions of the staple legs 12A before bending the entire staple legs 12A protruding from the sheet bundle P to bind the sheet bundle P is provided. The bending part 30A includes a first part disposed on an inner side of the pair of staple legs 12A and having a first tip portion facing the staple legs 12A and located at the first position of the staple legs 12A, a second part disposed on an outer side of each of the staple legs 12A and having a second tip portion facing the staple legs 12A and located on a non-sheet bundle side spaced from the sheet bundle P further than the first position of the staple legs 12A, and moving parts 301AL and 301AR configured to move the second part toward the staple legs 12A.

In the exemplary embodiment, the bending part 30A is configured by the cutting part 34A. In a process of cutting the staple legs 12A having penetrated the sheet bundle P, the bending part 30A (cutting part 34A) is configured to inwardly bend the pair of staple legs 12A at the first position P1 such that the tip sides of the staple legs 12A are directed inwardly, before cutting the staple legs 12A.

The bending part 30A (cutting part 34A) includes a movable member 31AL on an outer side of one staple leg 12A and a movable member 31AR on an outer side of the other staple leg 12A. Also, the bending part 30A (cutting part 34A) includes a receiving part 32A on an inner side of the pair of staple legs 12A.

The receiving part 32A is an example of the first part, and is provided to a support member 320A to which the movable members 31AL and 31AR are attached. The receiving part 32A is configured by providing the support member 320A integrally with a portion of a convex shape protruding in a predetermined width smaller than a width of the crown portion 11A of the staple 10A.

The movable members 31AL and 31AR are an example of the second part. The movable member 31AL is supported to the support member 320A by a shaft 320AL, and the movable member 31AR is supported to the support member 320A by a shaft 320AR. The shafts 320AL and 320AR are attached to an upper surface, which is one surface of the support member 320A, in such a shape of protruding in a direction perpendicular to the support member 320A.

The shaft 320AL is inserted into a bearing part 310AL, so that the movable member 31AL is attached to the upper surface of the support member 320A so as to be rotatable about the shaft 320AL as a support point. The shaft 320AR is inserted into a bearing part 310AR, so that the movable member 31AR is attached to the upper surface of the support member 320A so as to be rotatable about the shaft 320AR as a support point.

The movable member 31AL has an operating portion 311AL provided at an end portion configured to move toward and away from the receiving part 32A and the staple leg 12A by a rotation operation about the shaft 320AL as a support point. The operating portion 311AL is an example of the second tip portion, and faces an outer surface of one staple leg 12A having penetrated the sheet bundle P. The movable member 31AR has an operating portion 311AR provided at an end portion configured to move toward and away from the receiving part 32A and the staple leg 12A by a rotation operation about the shaft 320AR as a support point. The operating portion 311AR is an example of the second tip portion, and faces an outer surface of the other staple leg 12A having penetrated the sheet bundle P.

The receiving part 32A has a first operated portion 321AL and a second operated portion 322AL at one end portion. The first operated portion 321AL is an example of the first tip portion, and faces an inner surface of one staple leg 12A having penetrated the sheet bundle P. The second operated portion 322AL faces the inner surface of one staple leg 12A having penetrated the sheet bundle P. The receiving part 32A has a first operated portion 321AR and a second operated portion 322AR at the other end portion. The first operated portion 321AR is an example of the first tip portion, and faces an inner surface of one staple leg 12A having penetrated the sheet bundle P. The second operated portion 322AR faces the inner surface of the other staple leg 12A having penetrated the sheet bundle P.

A direction perpendicular to a moving direction of the operating portion 311AL by the rotation operation of the movable member 31AL about the shaft 320AL as a support point and a direction perpendicular to a moving direction of the operating portion 311AR by the rotation operation of the movable member 31AR about the shaft 320AR as a support point are denoted with an arrow AZ. In the meantime, the arrow AZ direction is substantially parallel to the extension direction of the staple legs 12A of the staple 10A having penetrated the sheet bundle P.

Also, a direction along the moving direction of the operating portion 311AL and a direction along the moving direction of the operating portion 311AR by the rotation operation are denoted with an arrow AX.

The movable member 31AL is provided on a further upper side than the receiving part 32A in the arrow AZ direction. Also, the movable member 31AR is provided on a further upper side than the receiving part 32A in the arrow AZ direction. In the meantime, herein, the upper side is a direction away from the striking member 21A. Also, in the state shown in FIG. 1 and the like in which the sheet bundle P is sandwiched with the sheet sandwiching part 4A, a side away from the sheet bundle P is a sheet bundle side.

The receiving part 32A has the first operated portion 321AL and the second operated portion 322AL on upper and lower sides in the arrow AZ direction. The second operated portion 322AL is provided on a side, an upper side in this example, on which it is closer to the operating portion 311AL than the first operated portion 321AL in the arrow AZ direction.

The receiving part 32A has the first operated portion 321AR and the second operated portion 322AR on upper and lower sides in the arrow AZ direction. The second operated portion 322AR is provided on a side, an upper side in this example, on which it is closer to the operating portion 311AR than the first operated portion 321AR in the arrow AZ direction.

A tip of the first operated portion 321AL protrudes toward the staple leg 12A further than a tip of the second operated portion 322AL in the AX direction.

A tip of the first operated portion 321AR protrudes toward the facing staple leg 12A further than a tip of the second operated portion 322AR in the AX direction.

By the above configuration, the second operated portion 322AL is formed at one end portion of the receiving part 32A by a corner portion of an upper surface and one side surface of the receiving part 32A. Also, the first operated portion 321AL, which is a support point for bending the staple leg 12A, is formed at one end portion of the receiving part 32A by a corner portion at a predetermined position spaced from the second operating portion 322AL in the arrow AZ direction. In the arrow AX direction, the second operated portion 322AL is provided on a more inner side than the first operated portion 321AL, and the first operated portion 321AL protrudes toward the staple leg 12A further than the second operated portion 322AL. Also, the first operated portion 321AL includes an inclined portion 323AL inclined such that a thickness becomes smaller toward a tip facing one staple leg 12A.

The second operated portion 322AR is formed at the other end portion of the receiving part 32A by a corner portion of the upper surface and the other side surface of the receiving part 32A. Also, the first operated portion 321AR, which is a support point for bending the staple leg 12A, is formed at the other end portion of the receiving part 32A by a corner portion at a predetermined position spaced from the second operating portion 322AR in the arrow AZ direction. In the arrow AX direction, the second operated portion 322AR is provided on a more inner side than the first operated portion 321AR, and the first operated portion 321AR protrudes toward the staple leg 12A further than the second operated portion 322AR. Also, the first operated portion 321AR includes an inclined portion 323AR inclined such that a thickness becomes smaller toward a tip facing the other staple leg 12A. A portion of one staple leg 12A having penetrated the sheet bundle P, which is in contact with the first operated portion 321AL, is the first position P1 becoming a support point of the bending. Also, a portion of the other staple leg 12A having penetrated the sheet bundle P, which is in contact with the first operated portion 321AR, is the first position P1 becoming a support point of the bending. Also, the receiving part 32A is a fixed cutter configured to cut one staple leg 12A with the second operated portion 322AL and the operating portion 311AL of the movable member 31AL and to cut the other staple leg 12A with the second operated portion 322AR and the operating portion 311AR of the movable member 31AR. The receiving part 32A configures a first cutting edge by the second operated portions 322AL and 322AR located on the non-sheet bundle side than the first operated portions 321AL and 321AR.

The operating portion 311AL is provided on the non-sheet bundle side, which is a further upper side than the second operated portion 322AL in the arrow AZ direction. Also, the operating portion 311AR is provided on the non-sheet bundle side, which is a further upper side than the second operated portion 322AR in the arrow AZ direction.

The movable member 31AL is configured such that the operating portion 311AL is moved by the rotation operation about the shaft 320AL as a support point from a state, in which a predetermined gap through which the staple leg 12A is to pass is formed between the operating portion 311AL and the first operated portion 321AL and second operated portion 322AL of the receiving part 32A, to a position in which the operating portion 311AL passes the second operated portion 322AL.

The movable member 31AR is configured such that the operating portion 311AR is moved by the rotation operation about the shaft 320AR as a support point from a state, in which a predetermined gap through which the staple leg 12A is to pass is formed between the operating portion 311AR and the first operated portion 321AR and second operated portion 322AR of the receiving part 32A, to a position in which the operating portion 311AR passes the second operated portion 322AR. The movable member 31AL is a movable cutter configured to cut one staple leg 12A with the operating portion 311AL and the second operated portion 322AL of the receiving part 32A as the operating portion 311AL moves toward one staple leg 12A. The movable member 31AL configures a second cutting edge by the operating portion 311AL. Also, the movable member 31AR is a movable cutter configured to cut the other staple leg 12A with the operating portion 311AR and the second operated portion 322AR of the receiving part 32A as the operating portion 311AR moves toward the other staple leg 12A. The movable member 31AR configures a second cutting edge by the operating portion 311AR.

The bending part 30A includes moving parts 301AL and 301AR configured to move the movable members 31AL and 31AR toward the staple legs 12A. The moving parts 301AL and 301AR are configured to move the pair of movable members 31AL and 31AR away from and toward each other as the operation of the cam 51A shown in FIG. 1 and the like is transmitted via the link and the like. The moving part 301AL is configured to move one movable member 31AL toward one staple leg 12A located on an inner side of the movable member 31AL. The moving part 301AR is configured to move the other movable member 31AR toward the other staple leg 12A located on an inner side of the movable member 31AR. The clincher part 33A includes bending members 33AL and 33AR each of which is configured to bend one staple leg 12A, which has penetrated the sheet bundle P, of the staple 10A struck out by the striking member 21A. The bending members 33AL and 33AR are configured to linearly move toward and away from each other, and to rotate toward the sheet bundle P.

Figure 7:
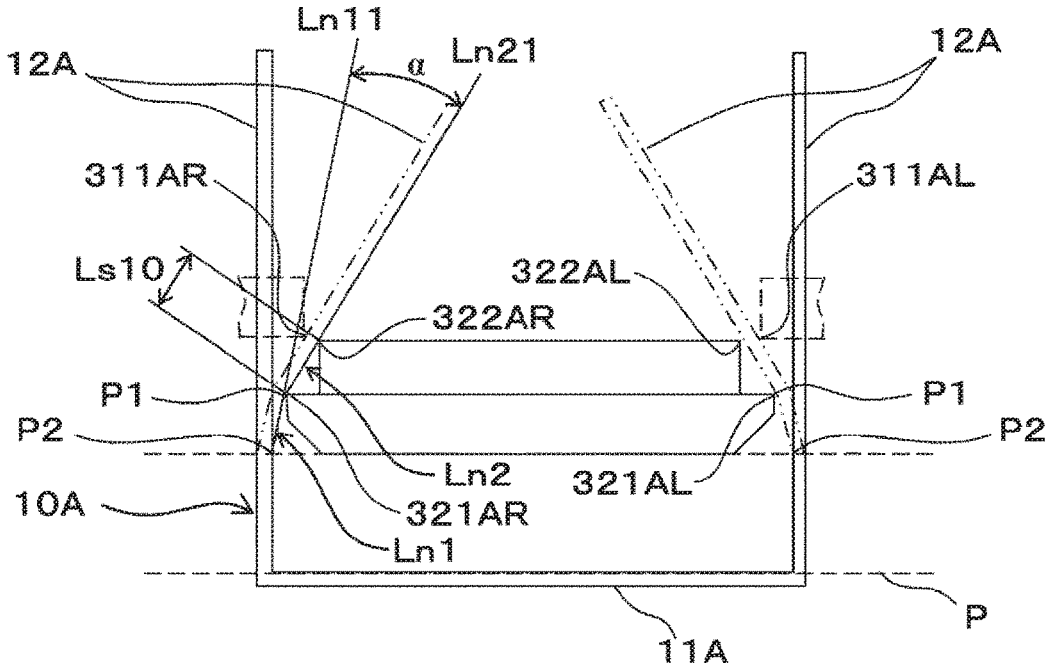
FIG. 7 illustrates a preferred manner of bending staple legs.

FIG. 7 illustrates a preferred manner of bending the staple legs 12A. The first operated portion 321AR (321AL) and second operated portion 322AR (322AL) of the receiving part 32A are configured such that an angle α between an extension line Ln11 of a virtual line Ln1 connecting the second position P2 of the staple legs 12A located on the upper surface of the sheet bundle and the first operated portion 321AR (321AL) and an extension line Ln21 of a virtual line Ln2 connecting the first operated portion 321AR (321AL) and the second operated portion 322AR (322AL) is preferably 15° or greater, and is more preferably within a range from 15° to 45°. When the angle α is 15° or less, the legs return by an amount of elastic deformation of a bent amount of the staple legs 12A bent at the first position P1, so that the bending is hardly formed.

Also, a length Ls10 of the virtual line Ln2 connecting the first operated portion 321AR (321AL) and the second operated portion 322AR (322AL) is preferably 3 mm or less. When a length from a bending portion of the staple leg 12A at the first position P1 to an end side increases, a spacing of the bending portion at the first position P1 from the surface of the sheet bundle P in a bound state also increases and a height of the staple leg 12A at the first position P1 upon the binding increases.

<Operation Example of Stapler of Exemplary Embodiment>

Figure 8A:
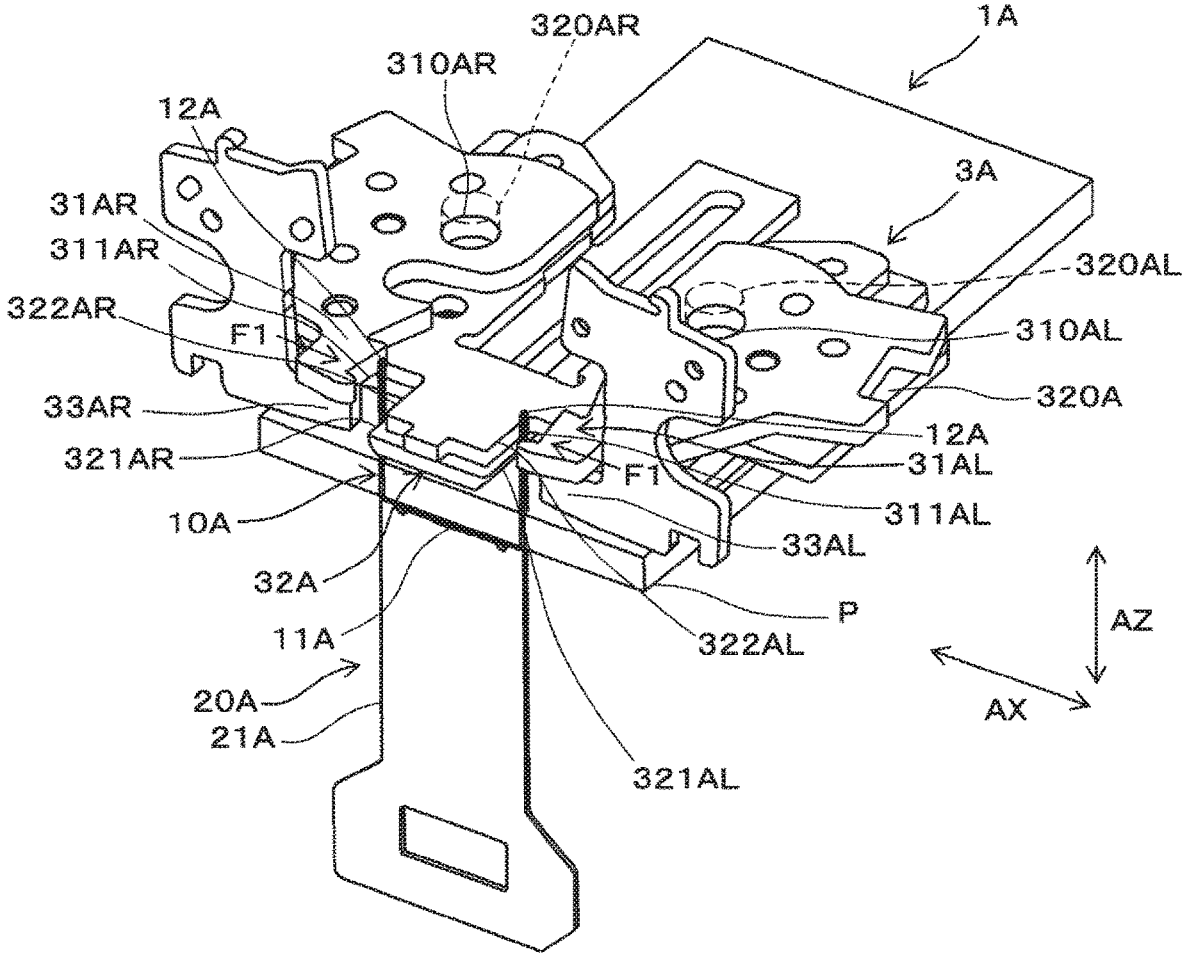
FIG. 8A is a perspective view illustrating an operation example of the stapler of the exemplary embodiment.
Figure 8B:
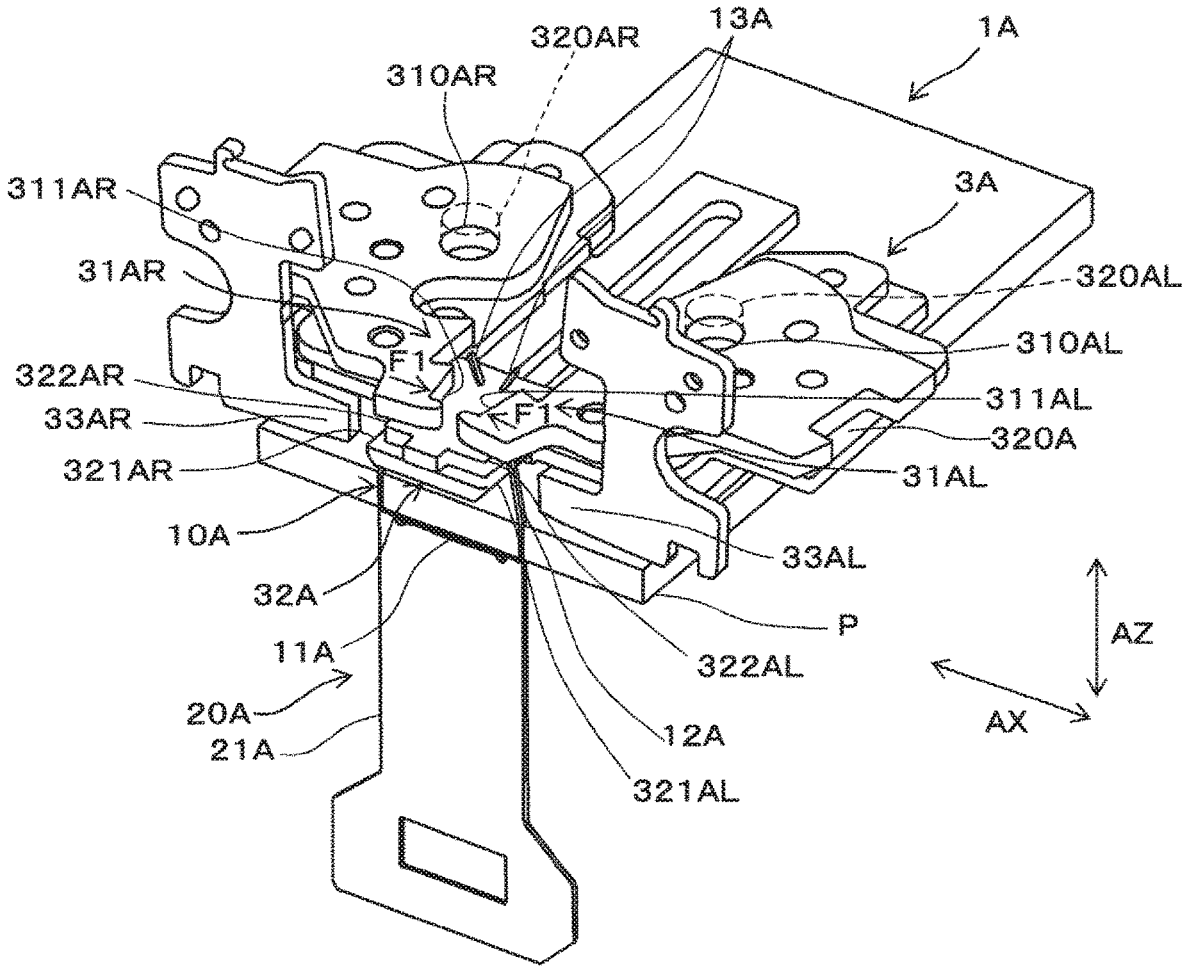
FIG. 8B is a perspective view illustrating an operation example of the stapler of the exemplary embodiment.
Figure 8C:
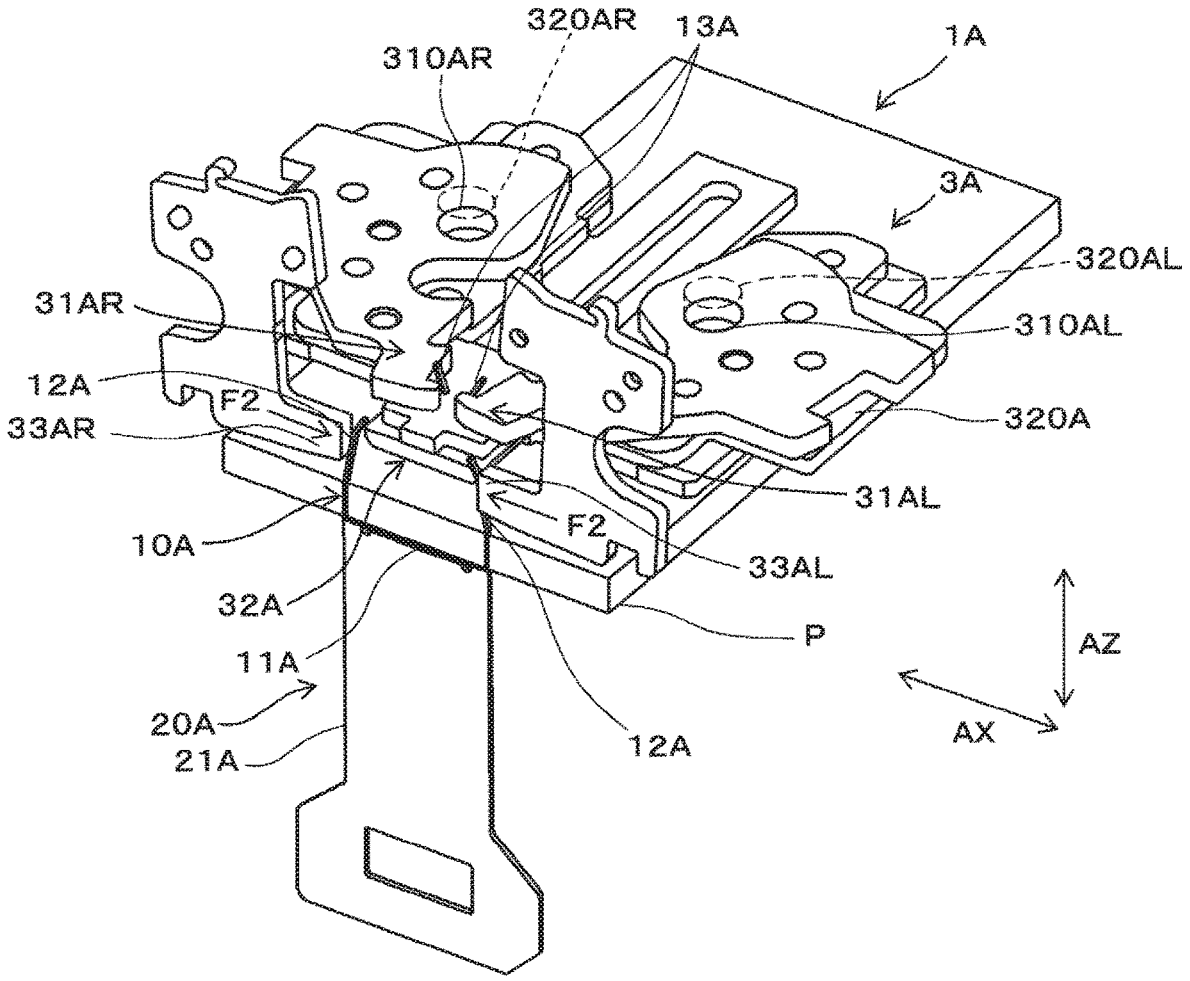
FIG. 8C is a perspective view illustrating an operation example of the stapler of the exemplary embodiment.
Figure 8D:
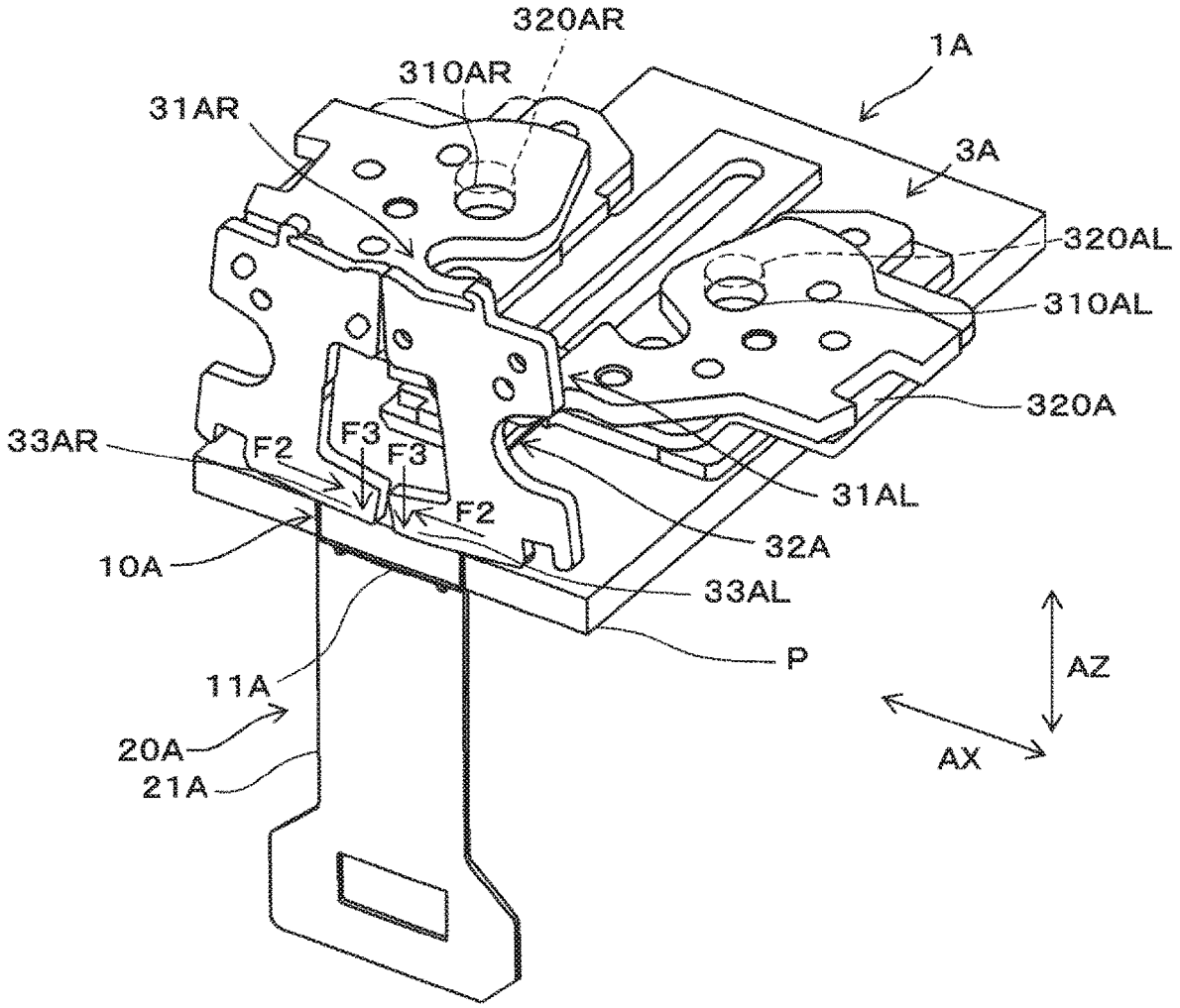
FIG. 8D is a perspective view illustrating an operation example of the stapler of the exemplary embodiment.
Figure 9A:
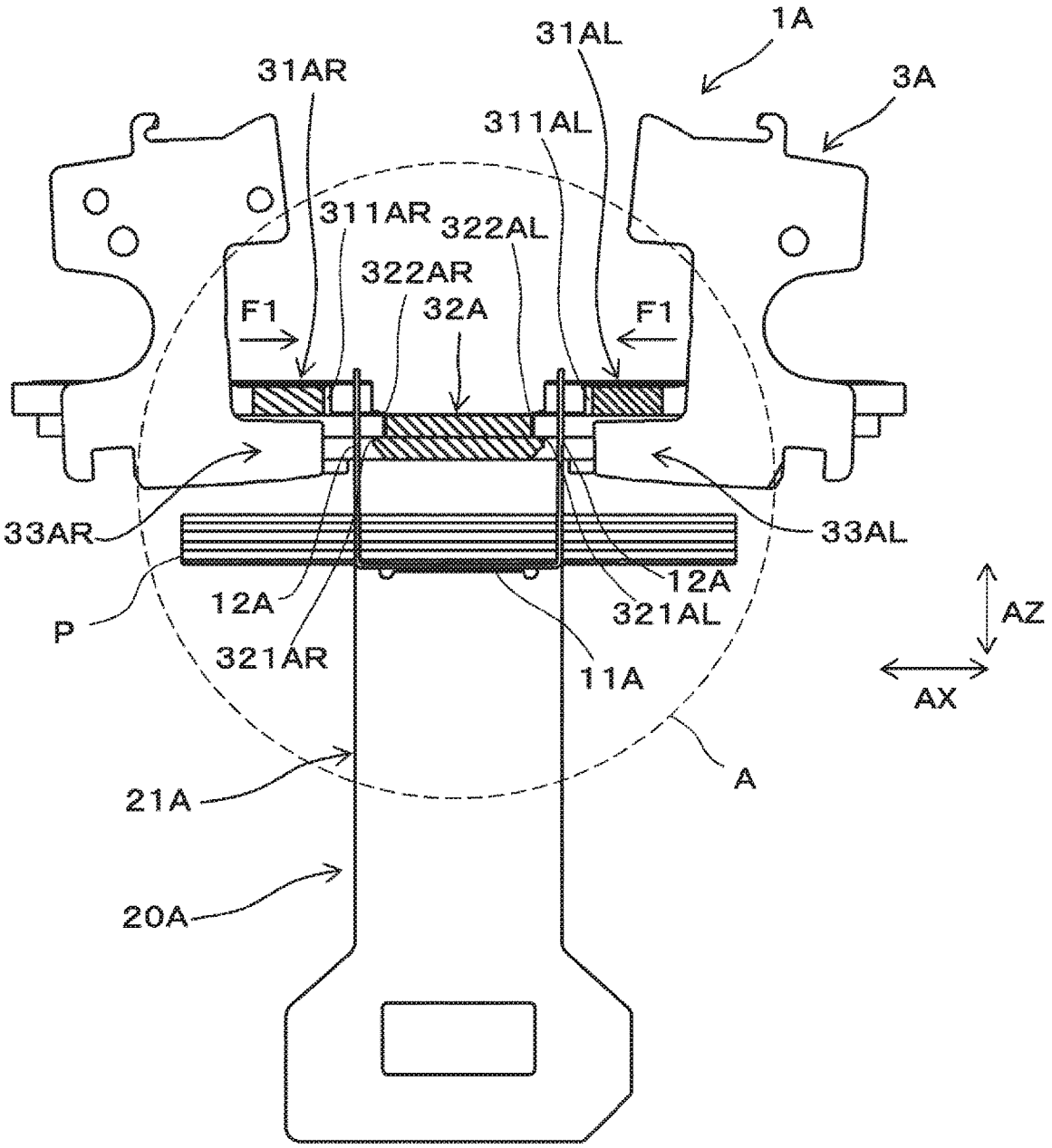
FIG. 9A is a front view illustrating an operation example of the stapler of the exemplary embodiment.
Figure 9B:
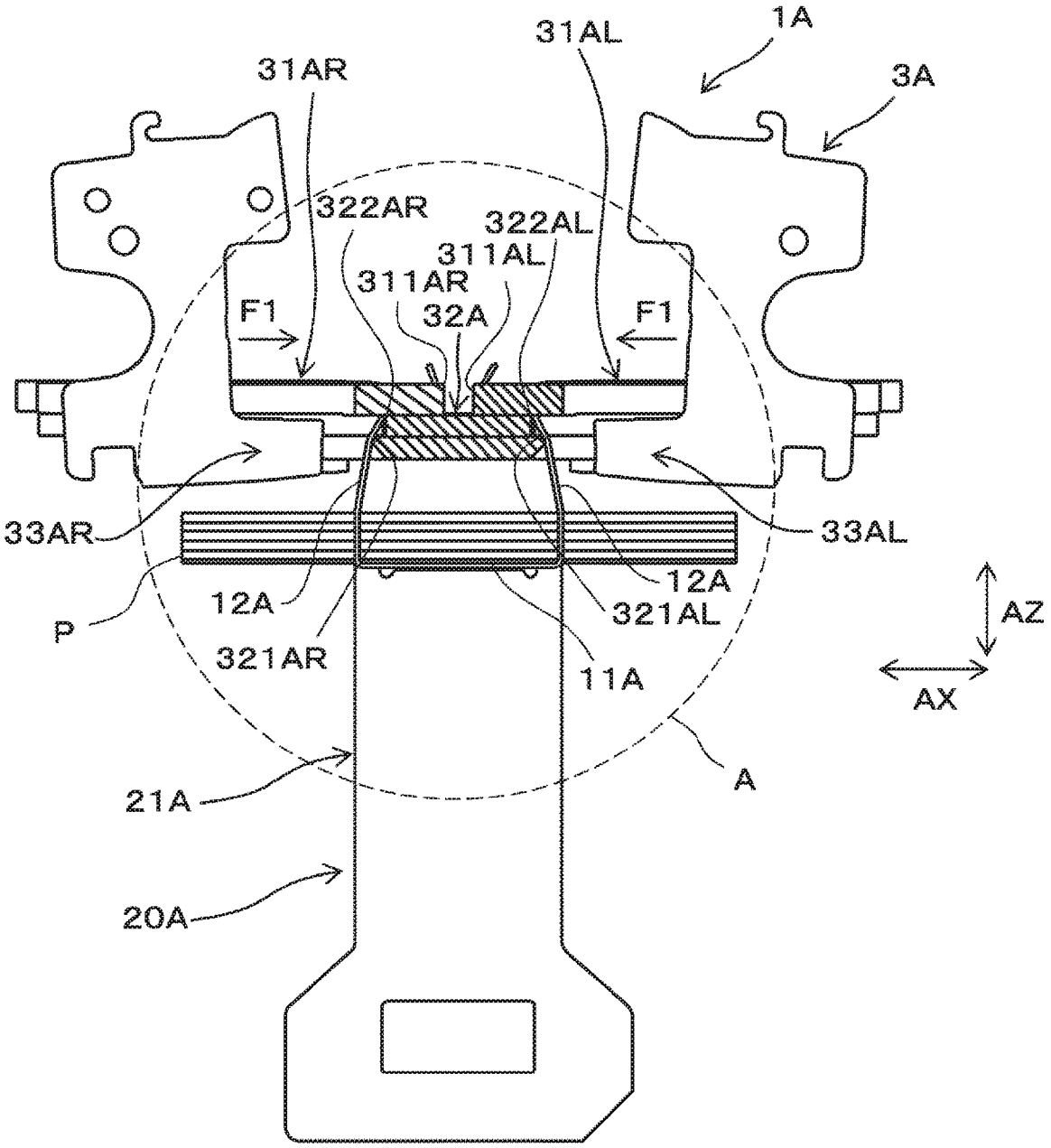
FIG. 9B is a front view illustrating an operation example of the stapler of the exemplary embodiment.
Figure 9C:
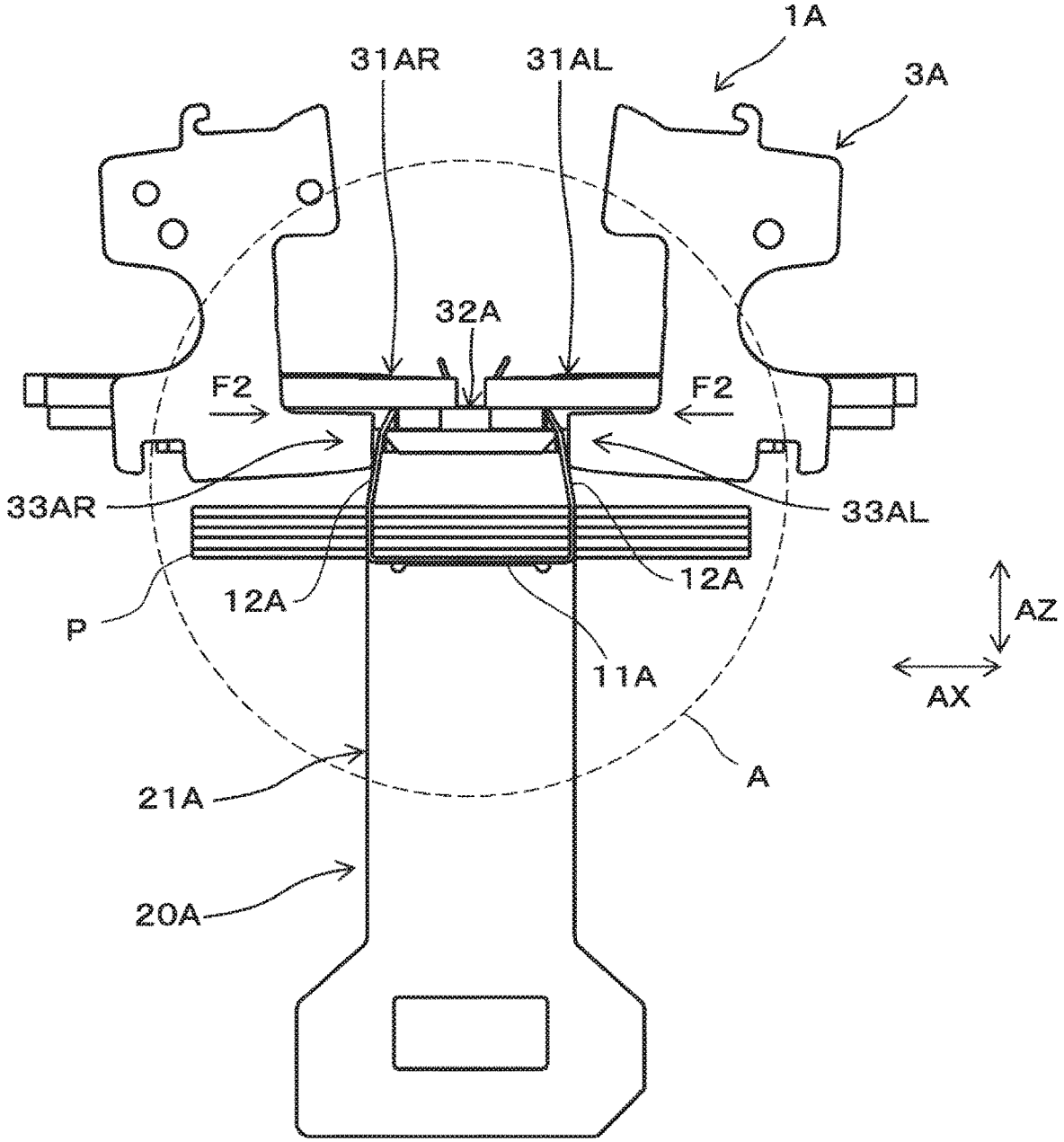
FIG. 9C is a front view illustrating an operation example of the stapler of the exemplary embodiment.

FIGS. 8A to 8D are perspective views illustrating an operation example of the stapler of the exemplary embodiment, and FIGS. 9A to 9D are front views illustrating an operation example of the stapler 1A of the exemplary embodiment. Also, FIG. 10A is an enlarged view of an A part in FIG. 9A, FIG. 10B is an enlarged view of an A part in FIG. 9B, FIG. 10C is an enlarged view of an A part in FIG. 9C, and FIG. 10D is an enlarged view of an A part in FIG. 9D. In the below, the operation of the stapler 1A of the exemplary embodiment is described with reference to the respective drawings.

FIGS. 8A, 9A and 10A illustrate a state where the movable members 31AL and 31AR are moved to a standby position. In the state where the movable members 31AL and 31AR are moved to the standby position, the movable member 31AL forms a predetermined gap between the operating portion 311AL and the first operated portion 321AL and second operated portion 322AL of the receiving part 32A. Also, the movable member 31AR forms a predetermined gap between the operating portion 311AR and the first operated portion 321AR and second operated portion 322AR of the receiving part 32A. The predetermined gap is a gap through which the staple 10A struck out by the striking member 21A can pass.

In the state where the movable members 31AL and 31AR are moved to the standby position, the binding unit 3A shown in FIG. 1 and the like is moved toward the striking unit 2A, so that the sheet bundle P is sandwiched in the sheet sandwiching part 4A.

The striking member 21A of the striking part 20A provided to the striking unit 2A presses the crown portion 11A of the formed staple 10A to strike out the staple 10A in the state where the sheet bundle P is sandwiched by the sheet sandwiching part 4A. The staple legs 12A of the staple 10A struck out by the striking member 21A penetrate the sheet bundle P. At this time, as shown in FIGS. 8A, 9A and 10A, one staple leg 12A passes between the operating portion 311AL and the first operated portion 321AL and second operated portion 322AL, and the other staple leg 12A passes between the operating portion 311AR and the first operated portion 321AR and second operated portion 322AR.

FIGS. 8B, 9B and 10B illustrate a state where the movable members 31AL and 31AR are moved to a cutting end position. In the state where the movable members 31AL and 31AR are moved to the cutting end position, the rotation of the movable member 31AL about the shaft 320AL as a support point causes the operating portion 311AL to move to a position in which the operating portion 311AL passes the second operated portion 322AL. Also, the rotation of the movable member 31AR about the shaft 320AR as a support point causes the operating portion 311AR to move to a position in which the operating portion 311AR passes the second operated portion 322AR.

As shown with an arrow F1 in FIGS. 8A, 9A, 10A, 8B, 9B and 10B, while the movable member 31AL moves from the standby position toward the cutting end position, the operating portion 311AL of the movable member 31AL first contacts an outer surface of one staple leg 12A. Also, while the movable member 31AR moves from the standby position toward the cutting end position, the operating portion 311AR of the movable member 31AR first contacts an outer surface of the other staple leg 12A.

An interval L1 between the first operated portions 321AL and 321AR of the receiving part 32A is smaller than a width L of the crown portion 11A. Thereby, force of pushing inwardly the portions of the pair of staple legs 12A protruding from the sheet bundle P is applied from the respective outer sides of the pair of staple legs 12A, so that the pair of staple legs 12A is respectively bent inwardly at the second position P2 of the staple legs 12A located closer to the sheet bundle P than the first position P1 on the upper surface of the sheet bundle P as a support point of the bending.

When the portions of the pair of staple legs 12A protruding from the sheet bundle P are respectively bent inwardly at the second position P2, one staple leg 12A is contacted to the first operated portion 321AL and the other staple leg 12A is contacted to the first operated portion 321AR.

An interval L2 between the second operated portions 322AL and 322AR of the receiving part 32A is smaller than the interval L1 between the first operated portions 321AL and 321AR. Also, in the state where the portions of the pair of staple legs 12A protruding from the sheet bundle P are bent inwardly at the second position P2 on the upper surface of the sheet bundle P as a support point and portions on further tip sides than the second position P2 are linear, the staple legs 12A are not in contact with the second operated portions 322AL and 322AR.

Thereby, in the state where one staple leg 12A is in contact with the first operated portion 321AL while the movable member 31AL is moved from the standby position toward the cutting end position, the force of pushing inwardly the one staple leg 12A is further applied, so that one staple leg 12A is further bent inwardly on the further tip side than the first position P1 by using the first operated portion 321AL as a support point and the portion in contact with the first operated portion 321AL as the first position P1. Also, in the state where the other staple leg 12A is in contact with the first operated portion 321AR while the movable member 31AR is moved from the standby position toward the cutting end position, the force of pushing inwardly the other staple leg 12A is further applied, so that the other staple leg 12A is further bent inwardly on the further tip side than the first position P1 by using the first operated portion 321AR as a support point and the portion in contact with the first operated portion 321AR as the first position P1.

When the portions of the pair of staple legs 12A protruding from the sheet bundle P are further bent inwardly at the first position P1 by using the first operated portions 321AL and 321AR as support points, one staple leg 12A is contacted to the second operated portion 322AL and the other staple leg 12A is contacted to the second operated portion 322AR.

In the state where the staple leg 12A is sandwiched between the operating portion 311AL of the movable member 31AL and the second operated portion 322AL of the receiving part 32A, the movable member 31AL is moved to the cutting end position, so that the staple leg 12A is sheared by the second cutting edge consisting of the operating portion 311AL and the first cutting edge consisting of the second operated portion 322AL, so that one staple leg 12A is cut. Also, in the state where the staple leg 12A is sandwiched between the operating portion 311AR of the movable member 31AR and the second operated portion 322AR of the receiving part 32A, the movable member 31AR is moved to the cutting end position, so that the staple leg 12A is sheared by the second cutting edge of the operating portion 311AR and the first cutting edge of the second operated portion 322AR, so that the other staple leg 12A is cut. The cut staples 13 are stored in the cut staple storing part 6A shown in FIG. 1 and the like.

One staple leg 12A of which the further tip side than the portion in contact with the second operated portion 322AL is cut has such a shape that the further tip side than the portion in contact with the first operated portion 321AL is bent inwardly at the first position P1 about the first operated portion 321AL as a support point. Also, the other staple leg 12A of which the further tip side than the portion in contact with the second operated portion 322AR is cut has such a shape that the further tip side than the portion in contact with the first operated portion 321AR is bent inwardly at the first position P1 about the first operated portion 321AR as a support point.

FIGS. 8C, 9C and 10C illustrate a state where the bending members 33AL and 33AR are moved to a bending start position. The bending members 33AL and 33AR are linearly moved toward each other, as shown with an arrow F2, thereby moving to the bending start position in which they are in contact with the outer surfaces of the staple legs 12A. The support member 320A is moved rearward in conjunction with the movement of the bending members 33AL and 33AR to the bending start position, so that the movable members 31AL and 31AR and the receiving part 32A are retreated from between the staple legs 12A and the bending members 33AL and 33AR.

Figure 9D:
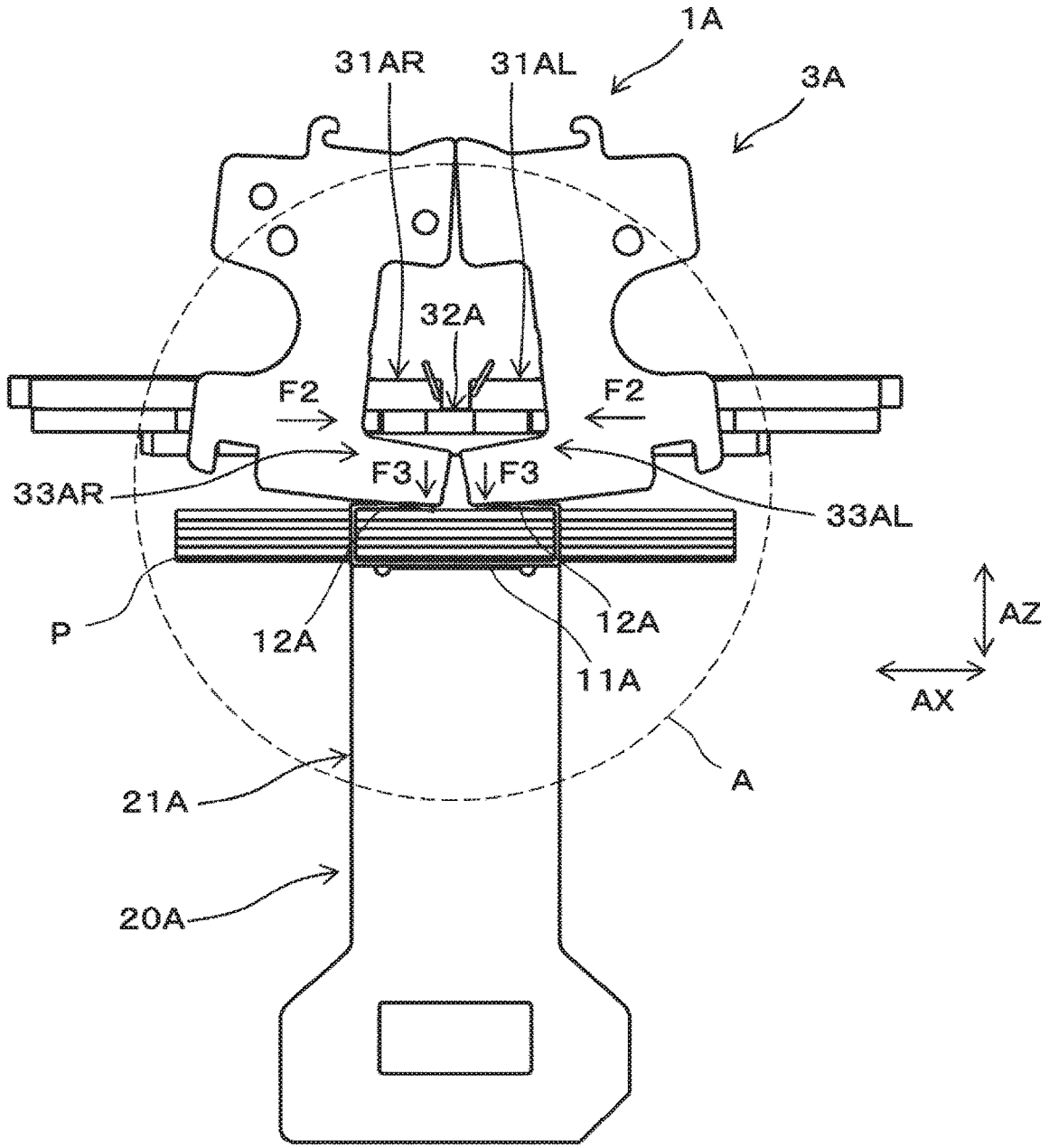
FIG. 9D is a front view illustrating an operation example of the stapler of the exemplary embodiment.
Figure 10A:
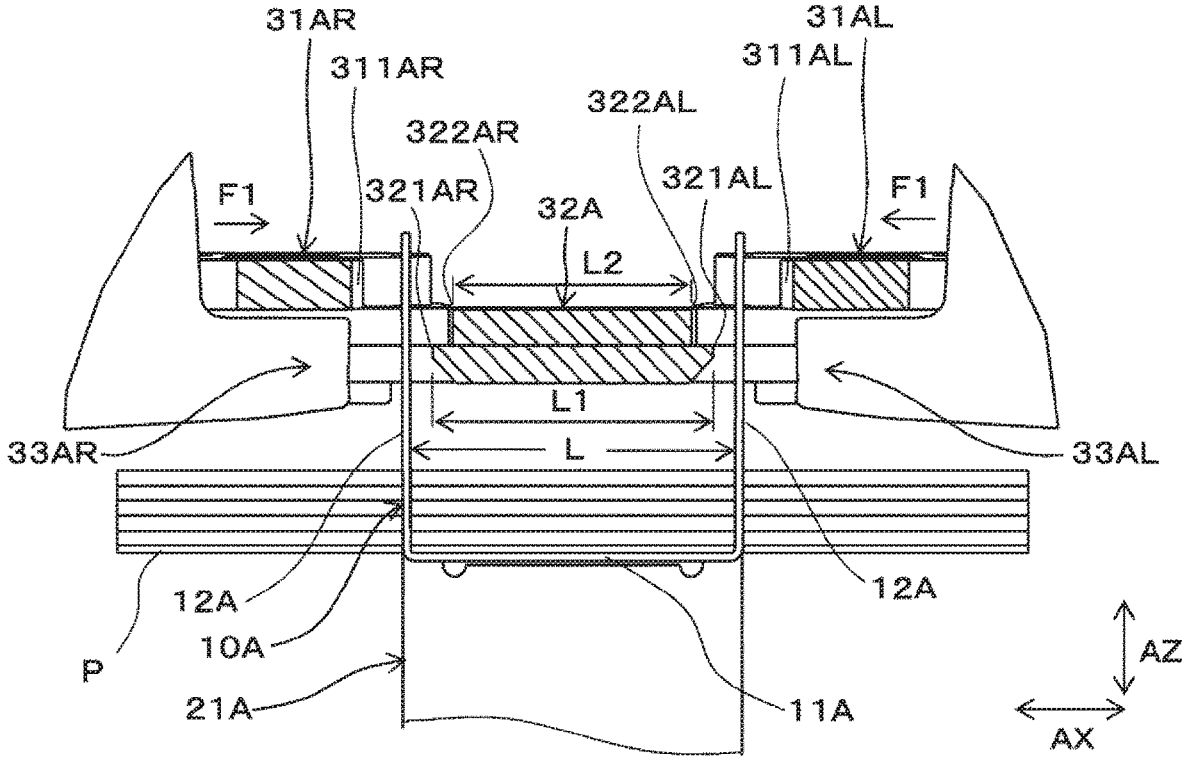
FIG. 10A is an enlarged view of an A part in FIG. 9A.
Figure 10B:
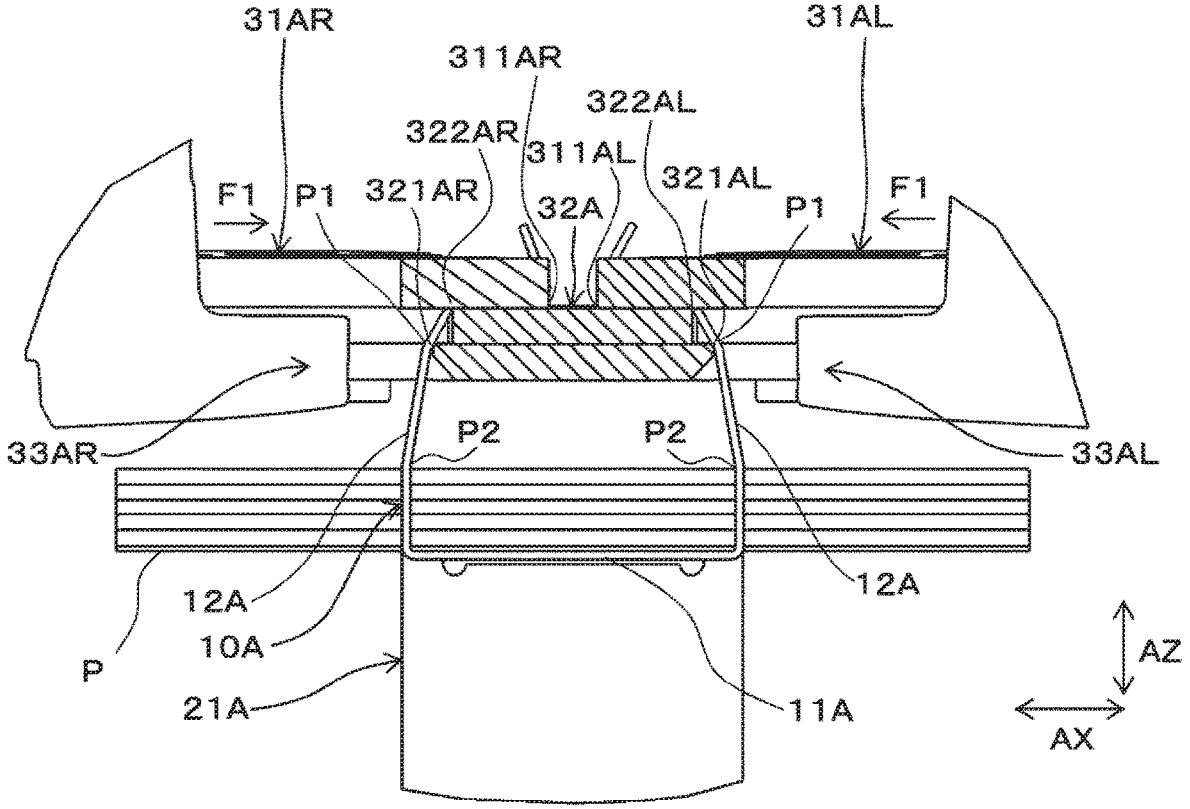
FIG. 10B is an enlarged view of an A part in FIG. 9B.
Figure 10C:
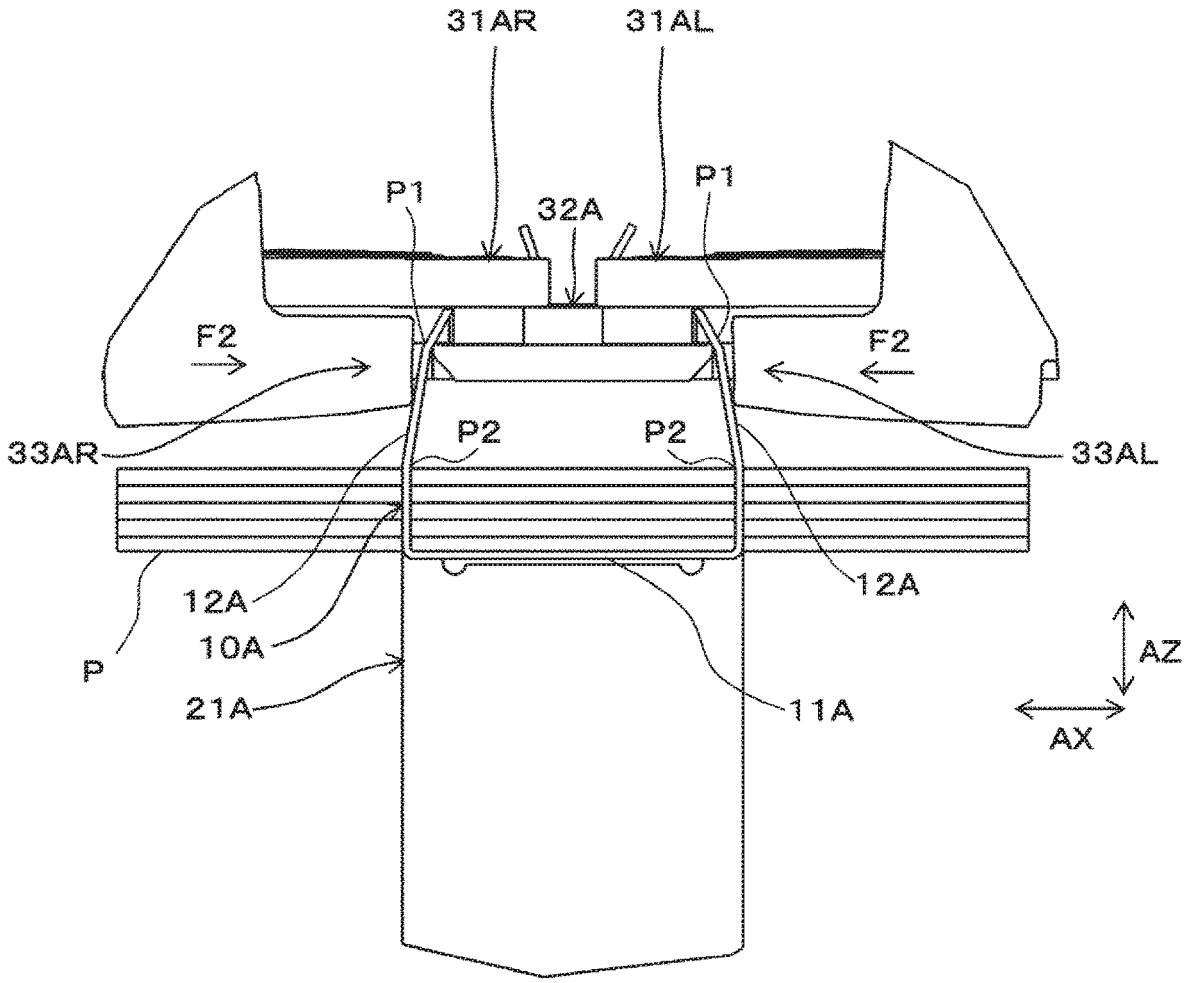
FIG. 10C is an enlarged view of an A part in FIG. 9C.
Figure 10D:
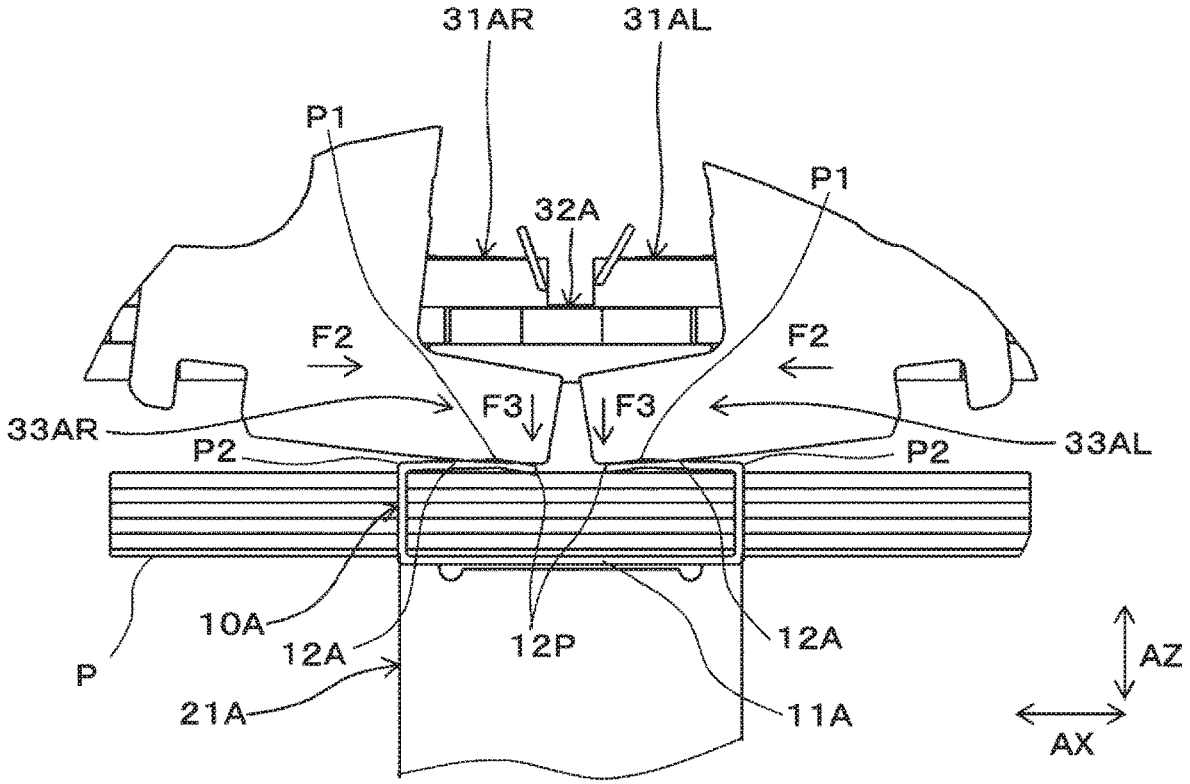
FIG. 10D is an enlarged view of an A part in FIG. 9D.

FIGS. 8D, 9D and 10D illustrate a state where the bending members 33AL and 33AR are moved to a bending end position. The bending members 33AL and 33AR are further moved linearly from the bending start position toward each other, as shown with the arrow F2, thereby pushing the staple legs 12A inwardly. While the bending member 33AL moves from the bending start position toward the bending end position, the force of pushing the staple leg 12A inwardly is applied, so that the portion, which protrudes from the sheet bundle P, of one staple leg 12A is further bent inwardly at the second position P2 on the upper surface of the sheet bundle P as a support point. Also, while the bending member 33AR moves from the bending start position toward the bending end position, the force of pushing the staple leg 12A inwardly is applied, so that the portion, which protrudes from the sheet bundle P, of the other staple leg 12A is further bent inwardly at the second position P2 on the upper surface of the sheet bundle P as a support point.

After the bending members 33AL and 33AR are linearly moved toward each other, the bending members 33AL and 33AR are rotated toward the sheet bundle P, as shown with an arrow F3. Thereby, the bending member 33AL presses one staple leg 12A to the sheet bundle P, and the bending member 33AR presses the other staple leg 12A to the sheet bundle P.

In the stapler 1A of the exemplary embodiment, while the staple legs 12A are cut by the movable members 31AL and 31AR, the staple legs 12A on the further tip side than the portions in contact with the first operated portions 321AL and 321AR are bent inwardly at the first position P1 about the first operated portions 321AL and 321AR as support points. Thereby, the tips of the staple legs 12A are difficult to float from the surface of the sheet bundle P.

<Modified Examples of Stapler of Exemplary Embodiment>

In the stapler 1A, the movable members 31AL and 31AR and the receiving part 32A have the functions of bending and cutting the tip sides of the staple legs 12A of the staple 10A. In contrast, in modified examples below, the movable member and the receiving part do not have the function of cutting the staple leg.

Figure 11A:
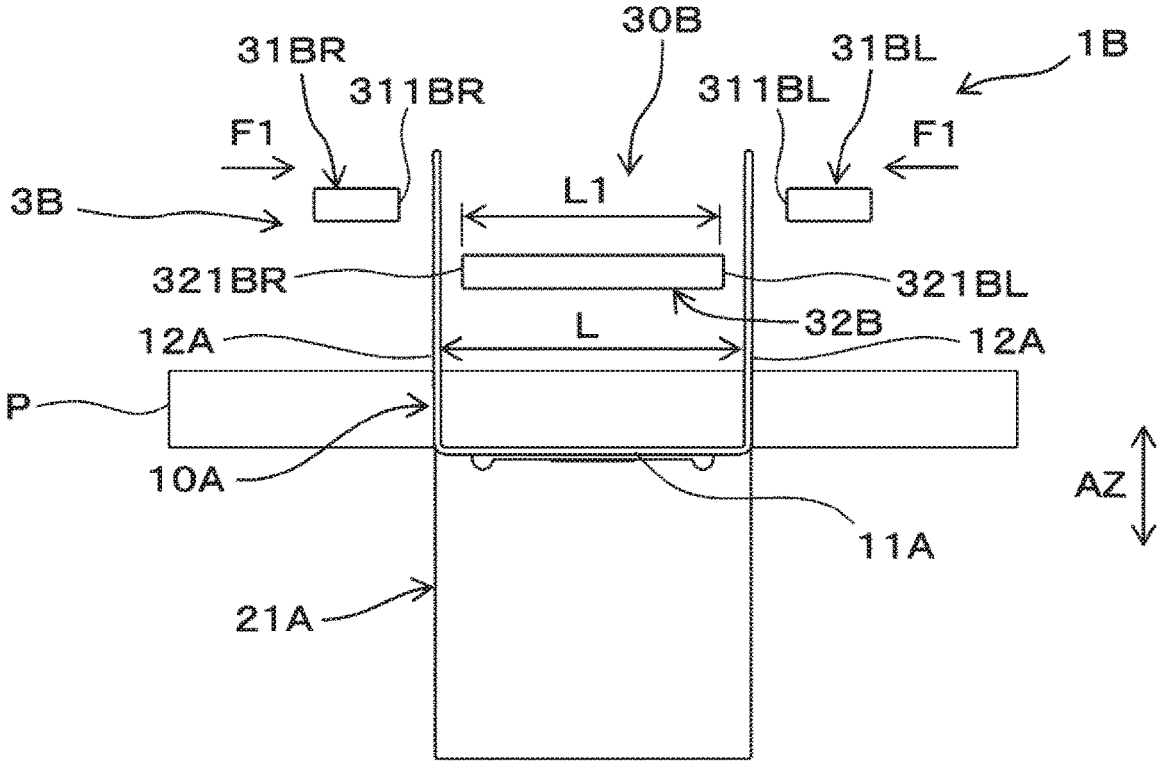
FIG. 11A is a configuration view illustrating a modified example of the stapler of the exemplary embodiment.
Figure 11B:
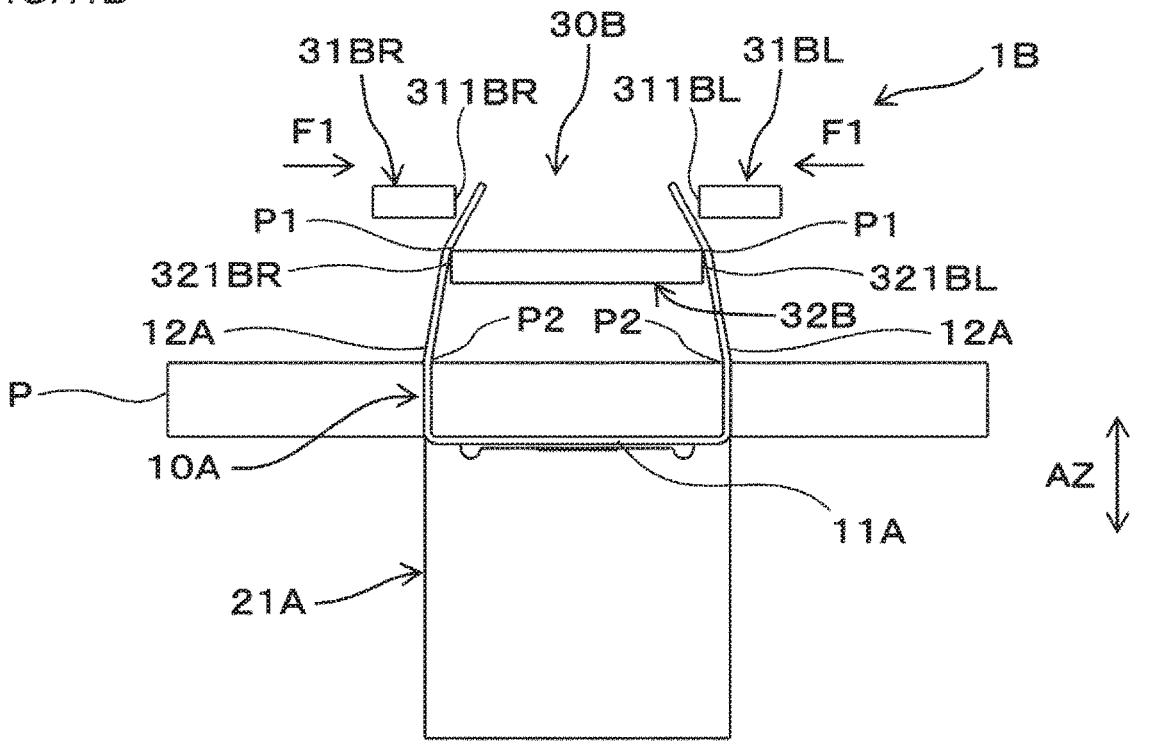
FIG. 11B is a configuration view illustrating the modified example of the stapler of the exemplary embodiment.

FIGS. 11A and 11B are configuration views illustrating a modified example of the stapler of the exemplary embodiment. An overall configuration of a stapler 1B is equivalent to the configuration shown in FIGS. 2A, 2B and 2C. The stapler 1B includes a bending part 30B configured to bend the staple legs 12A at the first position P1 such that the tips of the staple legs 12A having penetrated the sheet bundle P are directed inwardly.

The bending part 30B includes a movable member 31BL on the outer side of one staple leg 12A, and a movable member 31BR on the outer side of the other staple leg 12A. Also, the stapler 1B includes a receiving part 32B between the pair of staple legs 12A.

The receiving part 32B is an example of the first part, and has an operated portion 321BL at one end portion. The operated portion 321BL is an example of the first tip portion, and a portion thereof, which faces the inner surface of one staple leg 12A having penetrated the sheet bundle P, is formed to have a planar shape. The receiving part 32B has an operated portion 321BR at the other end portion. The operated portion 321BR is an example of the first tip portion, and a portion thereof, which faces the inner surface of the other staple leg 12A having penetrated the sheet bundle P, is formed to have a planar shape.

The movable members 31BL and 31BR are an example of the second part, and are configured to move toward and away from the receiving part 32B. The movable member 31BL has an operating portion 311BL at an end portion configured to move toward and away from the receiving part 32B. The operating portion 311BL is an example of the second tip portion, and a portion thereof, which faces the outer surface of one staple leg 12A having penetrated the sheet bundle P, is formed to have a planar shape. The movable member 31BR has an operating portion 311BR at an end portion configured to move toward and away from the receiving part 32B. The operating portion 311BR is an example of the second tip portion, and a portion thereof, which faces the outer surface of the other staple leg 12A having penetrated the sheet bundle P, is formed to have a planar shape.

In the arrow AZ direction, the movable member 31BL is provided on a further upper side than the receiving part 32B, and the operating portion 311BL of the movable member 31BL is provided on a further upper side than the operated portion 321BL of the receiving part 32B. Also, in the arrow AZ direction, the movable member 31BR is provided on a further upper side than the receiving part 32B, and the operating portion 311BR of the movable member 31BR is provided on a further upper side than the operated portion 321BR of the receiving part 32B.

FIG. 11A illustrates a state where the movable members 31BL and 31BR are moved to the standby position. In the state where the movable members 31BL and 31BR are moved to the standby position, the movable member 31BL forms a predetermined gap between the operating portion 311BL and the operated portion 321BL of the receiving part 32B. Also, the movable member 31BR forms a predetermined gap between the operating portion 311BR and the operated portion 321BR of the receiving part 32B.

The staple legs 12A of the staple 10A struck out with the striking member 21A penetrate the sheet bundle P, in which one staple leg 12A passes between the operating portion 311BL and the operated portion 321BL and the other staple leg 12A passes between the operating portion 311BR and the operated portion 321BR.

FIG. 11B illustrates a state where the movable members 31BL and 31BR are moved to the bending end position. In the state where the movable members 31BL and 31BR are moved to the bending end position, the movable member 31BL is moved to a position in which the operating portion 311BL passes the operated portion 321BL. Also, the movable member 31BR is moved to a position in which the operating portion 311BR passes the operated portion 321BR.

As shown with the arrow F1 in FIGS. 11A and 11B, while the movable member 31BL moves from the standby position toward the bending end position, the operating portion 311BL of the movable member 31BL first contacts the outer surface of one staple leg 12A. Also, while the movable member 31BR moves from the standby position toward the bending end position, the operating portion 311BR of the movable member 31BR first contacts the outer surface of the other staple leg 12A.

An interval L1 between the operated portions 321BL and 321BR of the receiving part 32B is smaller than the width L of the crown portion 11A. Thereby, the force of pushing inwardly the portions of the pair of staple legs 12A protruding from the sheet bundle P is applied from the respective outer sides of the pair of staple legs 12A, so that the pair of staple legs 12A is respectively bent inwardly at the second position P2 of the staple legs 12A located closer to the sheet bundle P than the first position P1 on the upper surface of the sheet bundle P as a support point of the bending.

When the portions of the pair of staple legs 12A protruding from the sheet bundle P are respectively bent inwardly, one staple leg 12A is contacted to the operated portion 321BL and the other staple leg 12A is contacted to the operated portion 321BR.

Thereby, in the state where one staple leg 12A is in contact with the operated portion 321BL while the movable member 31BL is moved from the standby position toward the bending end position, the force of pushing inwardly the one staple leg 12A is further applied. Therefore, one staple leg 12A is further bent inwardly on the further tip side than the first position P1 by using the operated portion 321BL as a support point and the portion in contact with the operated portion 321BL as the first position P1. Also, in the state where the other staple leg 12A is in contact with the operated portion 321BR while the movable member 31BR is moved from the standby position toward the bending end position, the force of pushing inwardly the other staple leg 12A is further applied. Therefore, the other staple leg 12A is further bent inwardly on the further tip side than the first position P1 by using the operated portion 321BR as a support point and the portion in contact with the operated portion 321BR as the first position P1. The operation of bending the entire staple legs 12A from the second position P2 is similar to that shown in FIGS. 8C, 8D, 9C, 9D, 10C and 10D.

Figure 12A:
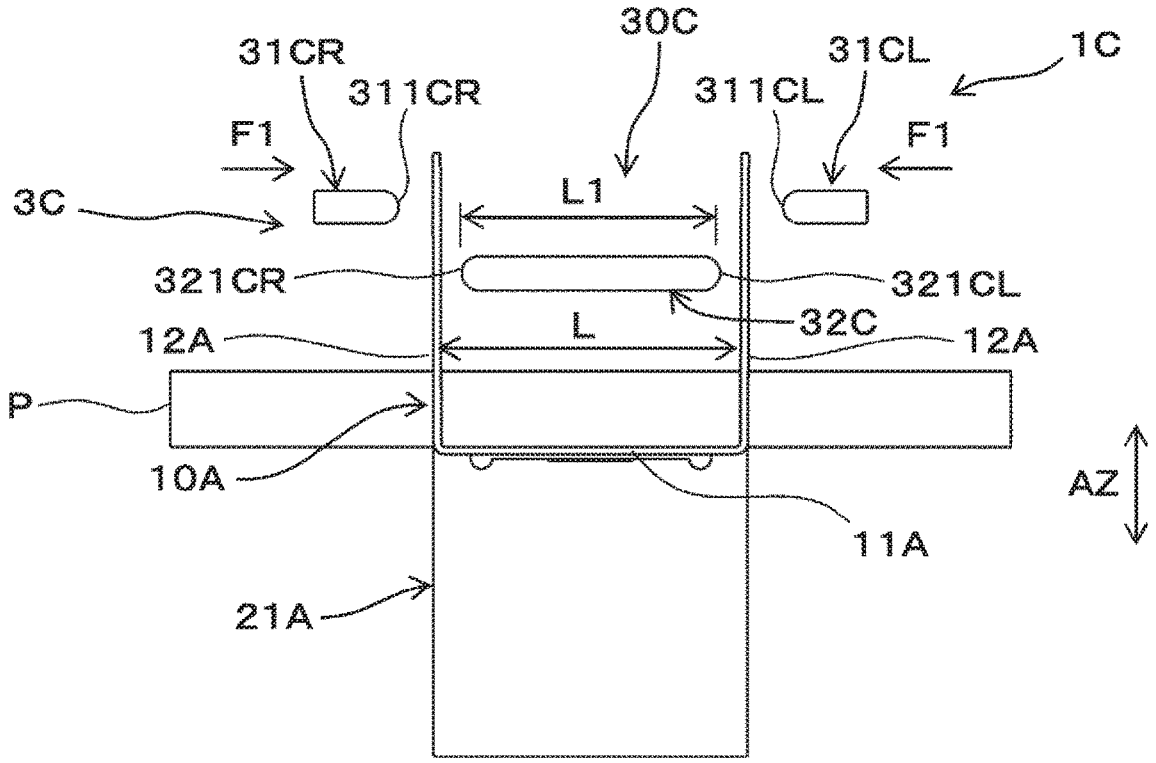
FIG. 12A is a configuration view illustrating a modified example of the stapler of the exemplary embodiment.
Figure 12B:
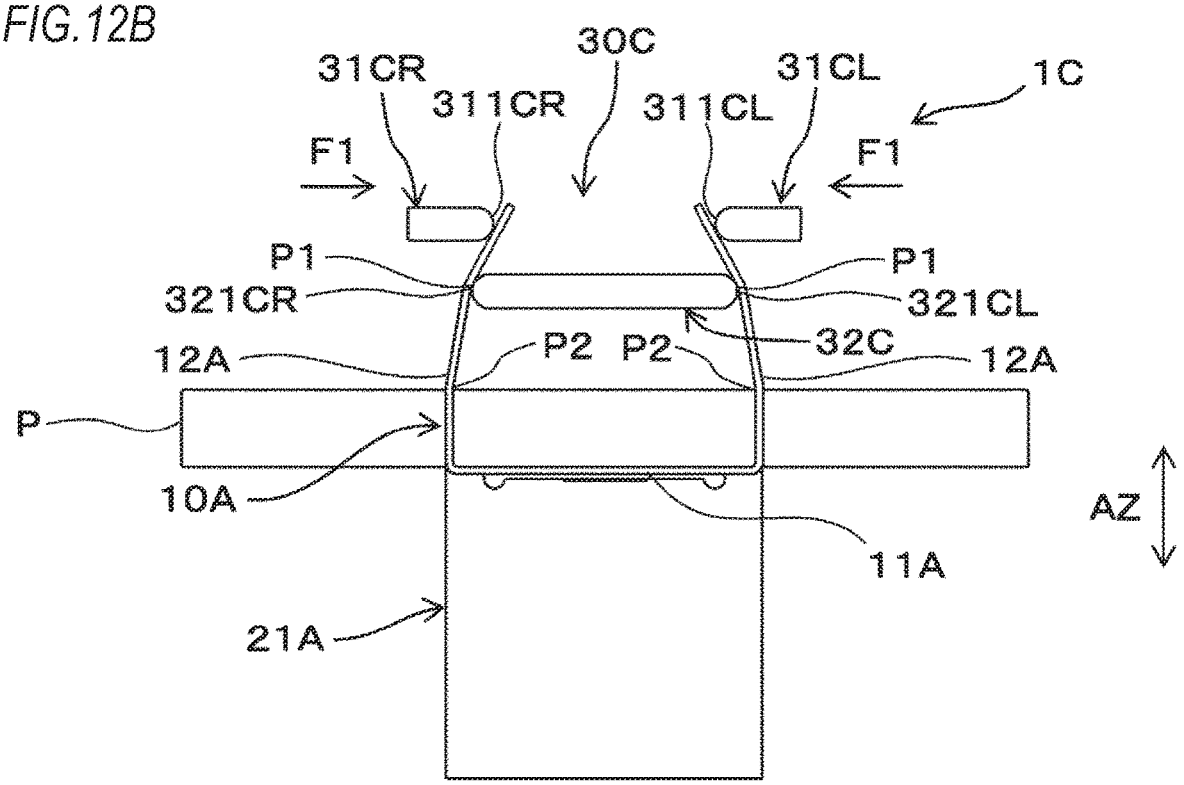
FIG. 12B is a configuration view illustrating the modified example of the stapler of the exemplary embodiment.

FIGS. 12A and 12B are configuration views illustrating a modified example of the stapler of the exemplary embodiment. An overall configuration of a stapler 1C is equivalent to the configuration shown in FIGS. 2A, 2B and 2C. The stapler 1C includes a bending part 30C configured to bend the staple legs 12A at the first position P1 such that the tips of the staple legs 12A having penetrated the sheet bundle P are directed inwardly.

The bending part 30C includes a movable member 31CL on the outer side of one staple leg 12A, and a movable member 31CR on the outer side of the other staple leg 12A. Also, the stapler 1C includes a receiving part 32C between the pair of staple legs 12A.

The receiving part 32C is an example of the first part, and has an operated portion 321CL at one end portion. The operated portion 321CL is an example of the first tip portion, and a portion thereof, which faces the inner surface of one staple leg 12A having penetrated the sheet bundle P, is formed to have a curved surface shape. The receiving part 32C has an operated portion 321CR at the other end portion. The operated portion 321CR is an example of the first tip portion, and a portion thereof, which faces the inner surface of the other staple leg 12A having penetrated the sheet bundle P, is formed to have a curved surface shape.

The movable members 31CL and 31CR are an example of the second part, and are configured to move toward and away from the receiving part 32C. The movable member 31CL has an operating portion 311CL at an end portion configured to move toward and away from the receiving part 32C. The operating portion 311CL is an example of the second tip portion, and a portion thereof, which faces the outer surface of one staple leg 12A having penetrated the sheet bundle P, is formed to have a curved surface shape. The movable member 31CR has an operating portion 311CR at an end portion configured to move toward and away from the receiving part 32C. The operating portion 311CR is an example of the second tip portion, and a portion thereof, which faces the outer surface of the other staple leg 12A having penetrated the sheet bundle P, is formed to have a curved surface shape.

In the arrow AZ direction, the movable member 31CL is provided on a further upper side than the receiving part 32C, and the operating portion 311CL of the movable member 31CL is provided on a further upper side than the operated portion 321CL of the receiving part 32C. Also, in the arrow AZ direction, the movable member 31CR is provided on a further upper side than the receiving part 32C, and the operating portion 311CR of the movable member 31CR is provided on a further upper side than the operated portion 321CR of the receiving part 32C.

FIG. 12A illustrates a state where the movable members 31CL and 31CR are moved to the standby position. In the state where the movable members 31CL and 31CR are moved to the standby position, the movable member 31CL forms a predetermined gap between the operating portion 311CL and the operated portion 321CL of the receiving part 32C. Also, the movable member 31CR forms a predetermined gap between the operating portion 311CR and the operated portion 321CR of the receiving part 32C.

The staple legs 12A of the staple 10A struck out with the striking member 21A penetrate the sheet bundle P, in which one staple leg 12A passes between the operating portion 311CL and the operated portion 321CL and the other staple leg 12A passes between the operating portion 311CR and the operated portion 321CR.

FIG. 12B illustrates a state where the movable members 31CL and 31CR are moved to the bending end position. In the state where the movable members 31CL and 31CR are moved to the bending end position, the movable member 31CL is moved to a position in which the operating portion 311CL passes the operated portion 321CL. Also, the movable member 31CR is moved to a position in which the operating portion 311CR passes the operated portion 321CR.

As shown with the arrow F1 in FIGS. 12A and 12B, while the movable member 31CL moves from the standby position toward the bending end position, the operating portion 311CL of the movable member 31CL first contacts the outer surface of one staple leg 12A. Since the operating portion 311CL is formed to have a curved surface shape, an apex of the curved surface becoming a convex shape contacts the staple leg 12A. Also, while the movable member 31CR moves from the standby position toward the bending end position, the operating portion 311CR first contacts the outer surface of the other staple leg 12A. Since the operating portion 311CR of the movable member 31CR is formed to have a curved surface shape, an apex of the curved surface becoming a convex shape contacts the staple leg 12A.

An interval L1 between the operated portions 321CL and 321CR of the receiving part 32B is smaller than the width L of the crown portion 11A. Thereby, the force of pushing inwardly the portions of the pair of staple legs 12A protruding from the sheet bundle P is applied from the respective outer sides of the pair of staple legs 12A, so that the pair of staple legs 12A is respectively bent inwardly in the second position P2 of the staple legs 12A located closer to the sheet bundle P than the first position P1 on the upper surface of the sheet bundle P as a support point of the bending.

When the portions of the pair of staple legs 12A protruding from the sheet bundle P are respectively bent inwardly, one staple leg 12A is contacted to the operated portion 321CL and the other staple leg 12A is contacted to the operated portion 321CR. Since the operated portion 321CL is formed to have a curved surface shape, an apex of the curved surface becoming a convex shape contacts the staple leg 12A. Also, since the operated portion 321CR is formed to have a curved surface shape, an apex of the curved surface becoming a convex shape contacts the staple leg 12A.

Thereby, in the state where one staple leg 12A is in contact with the operated portion 321CL while the movable member 31CL is moved from the standby position toward the bending end position, the force of pushing inwardly the one staple leg 12A is further applied. Therefore, one staple leg 12A is further bent inwardly on the further tip side than the first position P1 by using the operated portion 321CL as a support point and the portion in contact with the operated portion 321CL as the first position P1. Also, in the state where the other staple leg 12A is in contact with the operated portion 321CR while the movable member 31CR is moved from the standby position toward the bending end position, the force of pushing inwardly the other staple leg 12A is further applied. Therefore, the other staple leg 12A is further bent inwardly on the further tip side than the first position P1 by using the operated portion 321CR as a support point and the portion in contact with the operated portion 321CR as the first position P1. The operation of bending the entire staple legs 12A from the second position P2 is similar to that shown in FIGS. 8C, 8D, 9C, 9D, 10C and 10D.

Figure 13A:
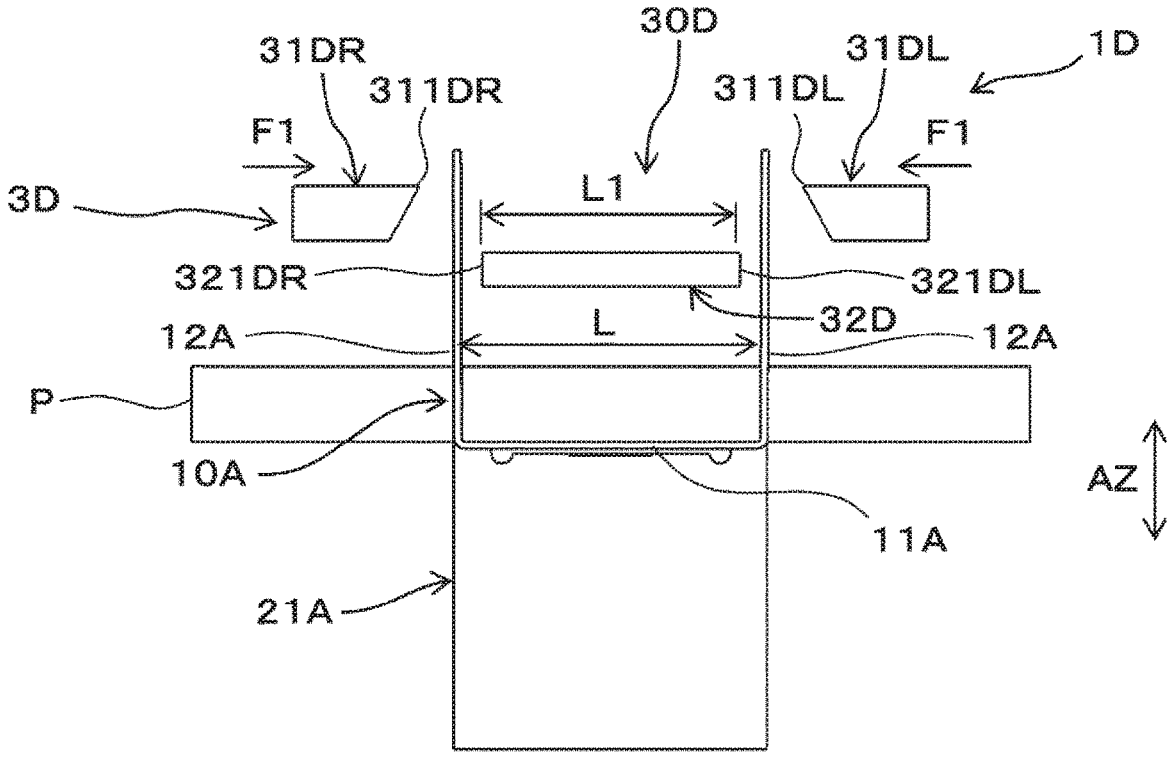
FIG. 13A is a configuration view illustrating a modified example of the stapler of the exemplary embodiment.
Figure 13B:
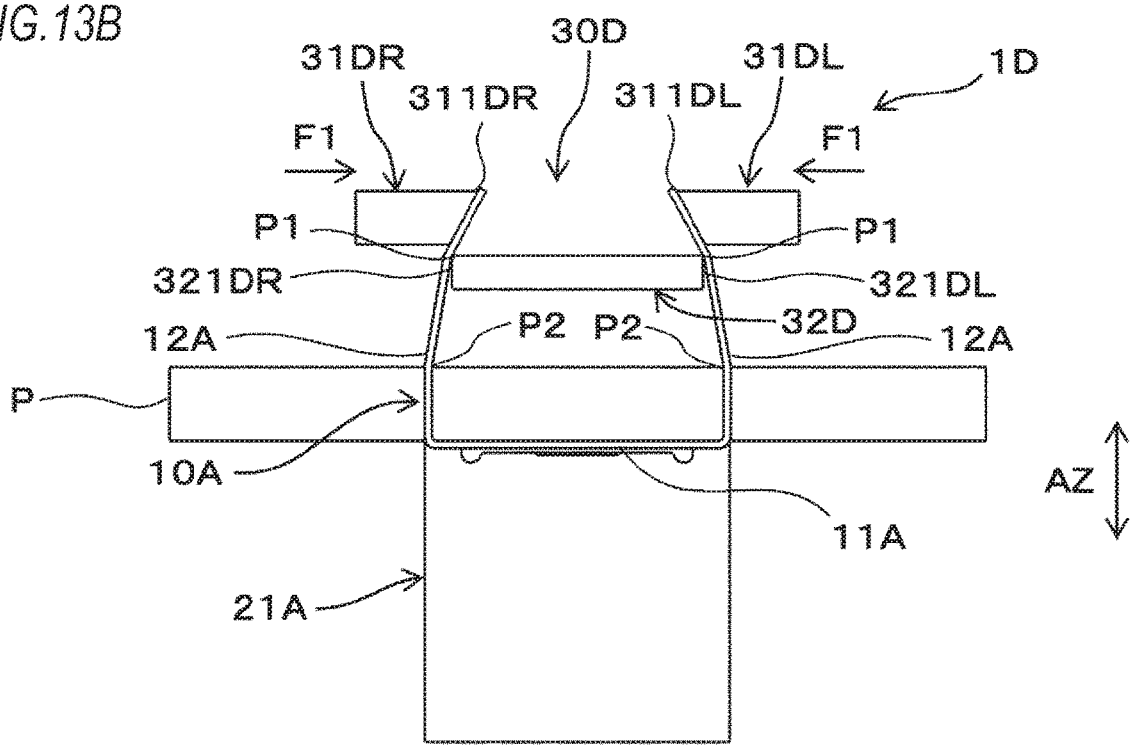
FIG. 13B is a configuration view illustrating the modified example of the stapler of the exemplary embodiment.

FIGS. 13A and 13B are configuration views illustrating a modified example of the stapler of the exemplary embodiment. An overall configuration of a stapler 1D is equivalent to the configuration shown in FIGS. 2A, 2B and 2C. The stapler 1D includes a bending part 30D configured to bend the staple legs 12A at the first position P1 such that the tips of the staple legs 12A having penetrated the sheet bundle P are directed inwardly.

The bending part 30D includes a movable member 31DL on the outer side of one staple leg 12A, and a movable member 31DR on the outer side of the other staple leg 12A. Also, the stapler 1D includes a receiving part 32D between the pair of staple legs 12A.

The receiving part 32D is an example of the first part, and has an operated portion 321DL at one end portion. The operated portion 321DL is an example of the first tip portion, and a portion thereof, which faces the inner surface of one staple leg 12A having penetrated the sheet bundle P, is formed to have a planar shape. The receiving part 32D has an operated portion 321DR at the other end portion. The operated portion 321DR is an example of the first tip portion, and a portion thereof, which faces the inner surface of the other staple leg 12A having penetrated the sheet bundle P, is formed to have a planar shape.

The movable members 31DL and 31DR are an example of the second part, and are configured to move toward and away from the receiving part 32D. The movable member 31DL has an operating portion 311DL at an end portion configured to move toward and away from the receiving part 32D. The operating portion 311DL is an example of the second tip portion, and a portion thereof, which faces the outer surface of one staple leg 12A having penetrated the sheet bundle P, is configured as an apex of a convex portion protruding in an acute angle shape. The movable member 31DR has an operating portion 311DR at an end portion configured to move toward and away from the receiving part 32D. The operating portion 311DR is an example of the second tip portion, and a portion thereof, which faces the outer surface of the other staple leg 12A having penetrated the sheet bundle P, is configured as an apex of a convex portion protruding in an acute angle shape.

In the arrow AZ direction, the movable member 31DL is provided on a further upper side than the receiving part 32D, and the operating portion 311DL of the movable member 31DL is provided on a further upper side than the operated portion 321DL of the receiving part 32D. Also, in the arrow AZ direction, the movable member 31DR is provided on a further upper side than the receiving part 32D, and the operating portion 311DR of the movable member 31DR is provided on a further upper side than the operated portion 321DR of the receiving part 32D.

FIG. 13A illustrates a state where the movable members 31DL and 31DR are moved to the standby position. In the state where the movable members 31DL and 31DR are moved to the standby position, the movable member 31DL forms a predetermined gap between the operating portion 311DL and the operated portion 321DL of the receiving part 32D. Also, the movable member 31DR forms a predetermined gap between the operating portion 311DR and the operated portion 321DR of the receiving part 32D.

The staple legs 12A of the staple 10A struck out with the striking member 21A penetrate the sheet bundle P, in which one staple leg 12A passes between the operating portion 311DL and the operated portion 321DL and the other staple leg 12A passes between the operating portion 311DR and the operated portion 321DR.

FIG. 13B illustrates a state where the movable members 31DL and 31DR are moved to the bending end position. In the state where the movable members 31DL and 31DR are moved to the bending end position, the movable member 31DL is moved to a position in which the operating portion 311DL passes the operated portion 321DL. Also, the movable member 31DR is moved to a position in which the operating portion 311DR passes the operated portion 321DR.

As shown with the arrow F1 in FIGS. 13A and 13B, while the movable member 31DL moves from the standby position toward the bending end position, the operating portion 311DL of the movable member 31DL first contacts the outer surface of one staple leg 12A. The operating portion 311DL contacts the staple leg 12A at the apex of the convex portion protruding in an acute angle shape. Also, while the movable member 31DR moves from the standby position toward the bending end position, the operating portion 311DR of the movable member 31DR first contacts the outer surface of the other staple leg 12A. The operating portion 311DR contacts the staple leg 12A at the apex of the convex portion protruding in an acute angle shape.

An interval L1 between the operated portions 321DL and 321DR of the receiving part 32D is smaller than the width L of the crown portion 11A. Thereby, the force of pushing inwardly the portions of the pair of staple legs 12A protruding from the sheet bundle P is applied from the respective outer sides of the pair of staple legs 12A, so that the pair of staple legs 12A is respectively bent inwardly at the second position P2 of the staple legs 12A located closer to the sheet bundle P than the first position P1 on the upper surface of the sheet bundle P as a support point of the bending.

When the portions of the pair of staple legs 12A protruding from the sheet bundle P are respectively bent inwardly, one staple leg 12A is contacted to the operated portion 321DL and the other staple leg 12A is contacted to the operated portion 321DR Thereby, in the state where one staple leg 12A is in contact with the operated portion 321DL while the movable member 31DL is moved from the standby position toward the bending end position, the force of pushing inwardly the one staple leg 12A is further applied. Therefore, one staple leg 12A is further bent inwardly on the further tip side than the first position P1 by using the operated portion 321DL as a support point and the portion in contact with the operated portion 321DL as the first position P1. Also, in the state where the other staple leg 12A is in contact with the operated portion 321DR while the movable member 31DR is moved from the standby position toward the bending end position, the force of pushing inwardly the other staple leg 12A is further applied. Therefore, the other staple leg 12A is further bent inwardly on the further tip side than the first position P1 by using the operated portion 321DR as a support point and the portion in contact with the operated portion 321DR as the first position P1. The operation of bending the entire staple legs 12A from the second position P2 is similar to that shown in FIGS. 8C, 8D, 9C, 9D, 10C and 10D.

Figure 14A:
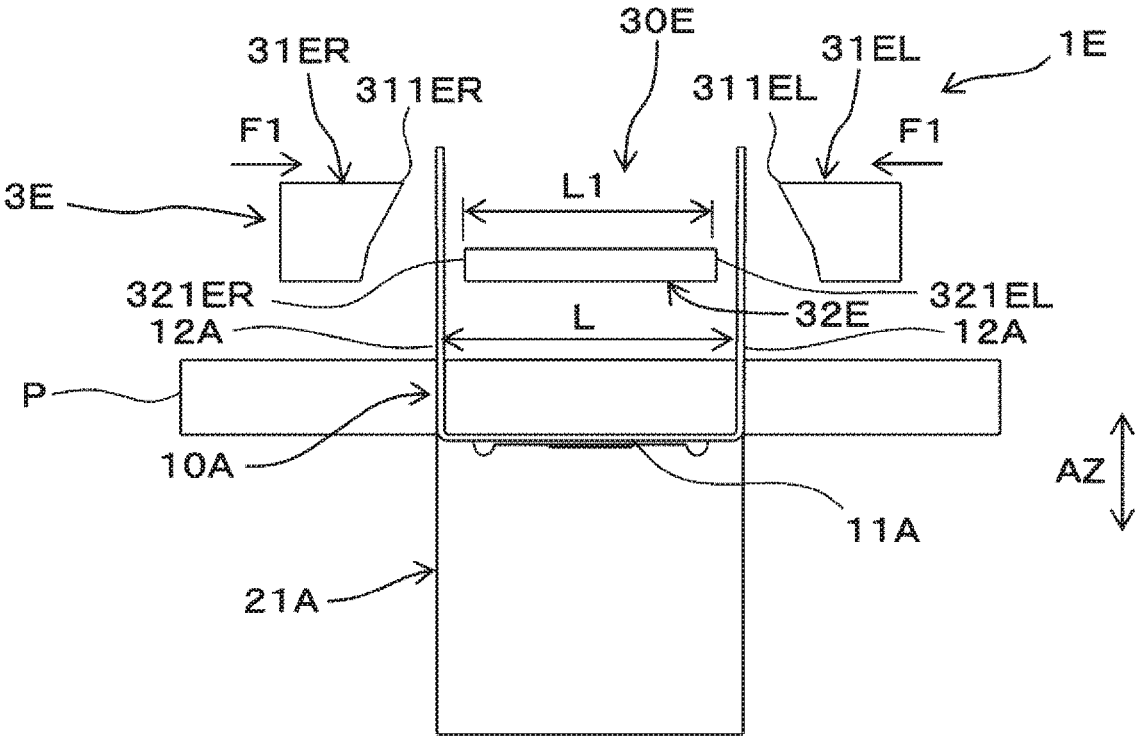
FIG. 14A is a configuration view illustrating a modified example of the stapler of the exemplary embodiment.
Figure 14B:
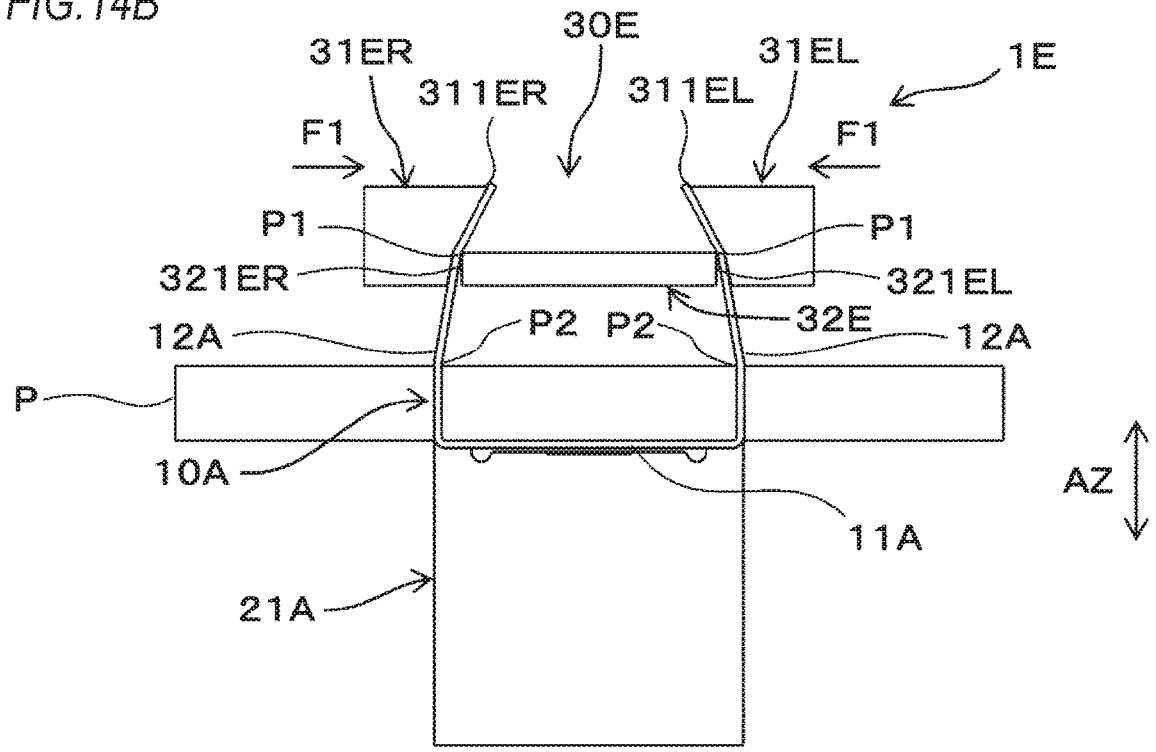
FIG. 14B is a configuration view illustrating the modified example of the stapler of the exemplary embodiment.

FIGS. 14A and 14B are configuration views illustrating a modified example of the stapler of the exemplary embodiment. An overall configuration of a stapler 1E is equivalent to the configuration shown in FIGS. 2A, 2B and 2C. The stapler 1E includes a bending part 30E configured to bend the staple legs 12A at the first position P1 such that the tips of the staple legs 12A having penetrated the sheet bundle P are directed inwardly.

The bending part 30E includes a movable member 31EL on the outer side of one staple leg 12A, and a movable member 31ER on the outer side of the other staple leg 12A. Also, the stapler 1E includes a receiving part 32E between the pair of staple legs 12A.

The receiving part 32E is an example of the first part, and has an operated portion 321EL at one end portion. The operated portion 321EL is an example of the first tip portion, and a portion thereof, which faces the inner surface of one staple leg 12A having penetrated the sheet bundle P, is formed to have a planar shape. The receiving part 32E has an operated portion 321ER at the other end portion. The operated portion 321ER is an example of the first tip portion, and a portion thereof, which faces the inner surface of the other staple leg 12A having penetrated the sheet bundle P, is formed to have a planar shape.

The movable members 31EL and 31ER are an example of the second part, and are configured to move toward and away from the receiving part 32E. The movable member 31EL has an operating portion 311EL at an end portion configured to move toward and away from the receiving part 32E. The operating portion 311EL is an example of the second tip portion, and a portion thereof, which faces the outer surface of one staple leg 12A having penetrated the sheet bundle P, is configured as an apex of a convex portion protruding in an acute angle shape. The movable member 31ER has an operating portion 311ER at an end portion configured to move toward and away from the receiving part 32E. The operating portion 311ER is an example of the second tip portion, and a portion thereof, which faces the outer surface of the other staple leg 12A having penetrated the sheet bundle P, is configured as an apex of a convex portion protruding in an acute angle shape.

In the arrow AZ direction, the movable member 31EL is partially provided on a further upper side than the receiving part 32E, and the operating portion 311EL of the movable member 31EL is provided on a further upper side than the operated portion 321EL of the receiving part 32E. Also, in the arrow AZ direction, the movable member 31ER is partially provided on a further upper side than the receiving part 32E, and the operating portion 311ER of the movable member 31ER is provided on a further upper side than the operated portion 321ER of the receiving part 32E.

FIG. 14A illustrates a state where the movable members 31EL and 31ER are moved to the standby position. In the state where the movable members 31EL and 31ER are moved to the standby position, the movable member 31EL forms a predetermined gap between the operating portion 311EL and the operated portion 321EL of the receiving part 32E. Also, the movable member 31ER forms a predetermined gap between the operating portion 311ER and the operated portion 321ER of the receiving part 32E.

The staple legs 12A of the staple 10A struck out with the striking member 21A penetrate the sheet bundle P, in which one staple leg 12A passes between the operating portion 311EL and the operated portion 321EL and the other staple leg 12A passes between the operating portion 311ER and the operated portion 321ER.

FIG. 14B illustrates a state where the movable members 31EL and 31ER are moved to the bending end position. In the state where the movable members 31EL and 31ER are moved to the bending end position, the movable member 31EL is moved to a position in which the operating portion 311EL passes the operated portion 321EL. Also, the movable member 31ER is moved to a position in which the operating portion 311ER passes the operated portion 321ER.

As shown with the arrow F1 in FIGS. 14A and 14B, while the movable member 31EL moves from the standby position toward the bending end position, the operating portion 311EL of the movable member 31EL first contacts the outer surface of one staple leg 12A. The operating portion 311EL contacts the staple leg 12A at the apex of the convex portion protruding in an acute angle shape. Also, while the movable member 31ER moves from the standby position toward the bending end position, the operating portion 311ER of the movable member 31ER first contacts the outer surface of the other staple leg 12A. The operating portion 311ER contacts the staple leg 12A at the apex of the convex portion protruding in an acute angle shape.

An interval L1 between the operated portions 321EL and 321ER of the receiving part 32E is smaller than the width L of the crown portion 11A. Thereby, the force of pushing inwardly the portions of the pair of staple legs 12A protruding from the sheet bundle P is applied from the respective outer sides of the pair of staple legs 12A, so that the pair of staple legs 12A is respectively bent inwardly in the second position P2 of the staple legs 12A located closer to the sheet bundle P than the first position P1 on the upper surface of the sheet bundle P as a support point of the bending.

When the portions of the pair of staple legs 12A protruding from the sheet bundle P are respectively bent inwardly, one staple leg 12A is contacted to the operated portion 321EL and the other staple leg 12A is contacted to the operated portion 321ER Thereby, in the state where one staple leg 12A is in contact with the operated portion 321EL while the movable member 31EL is moved from the standby position toward the bending end position, the force of pushing inwardly the one staple leg 12A is further applied. Therefore, one staple leg 12A is further bent inwardly on the further tip side than the first position P1 by using the operated portion 321EL as a support point and the portion in contact with the operated portion 321EL as the first position P1. Also, in the state where the other staple leg 12A is in contact with the operated portion 321ER while the movable member 31ER is moved from the standby position toward the bending end position, the force of pushing inwardly the other staple leg 12A is further applied. Therefore, the other staple leg 12A is further bent inwardly on the further tip side than the first position P1 by using the operated portion 321ER as a support point and the portion in contact with the operated portion 321ER as the first position P1. The operation of bending the entire staple legs 12A from the second position P2 is similar to that shown in FIGS. 8C, 8D, 9C, 9D, 10C and 10D.

Figure 15A:
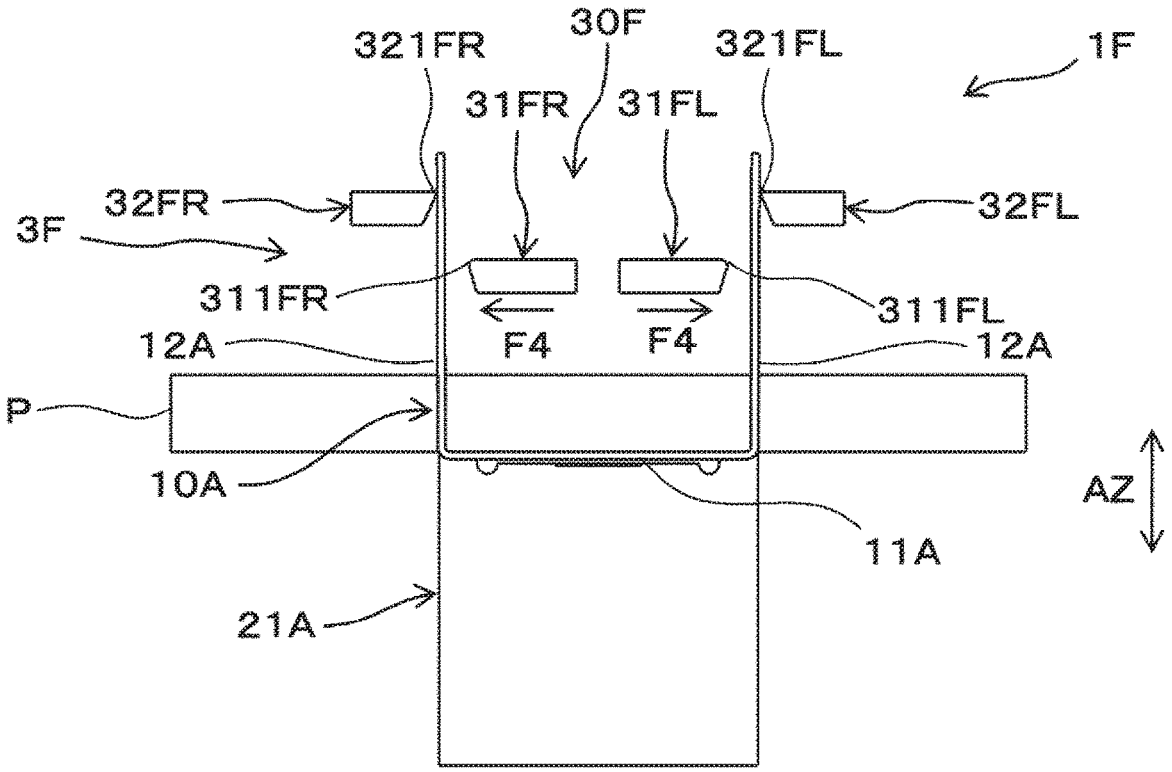
FIG. 15A is a configuration view illustrating a modified example of the stapler of the exemplary embodiment.
Figure 15B:
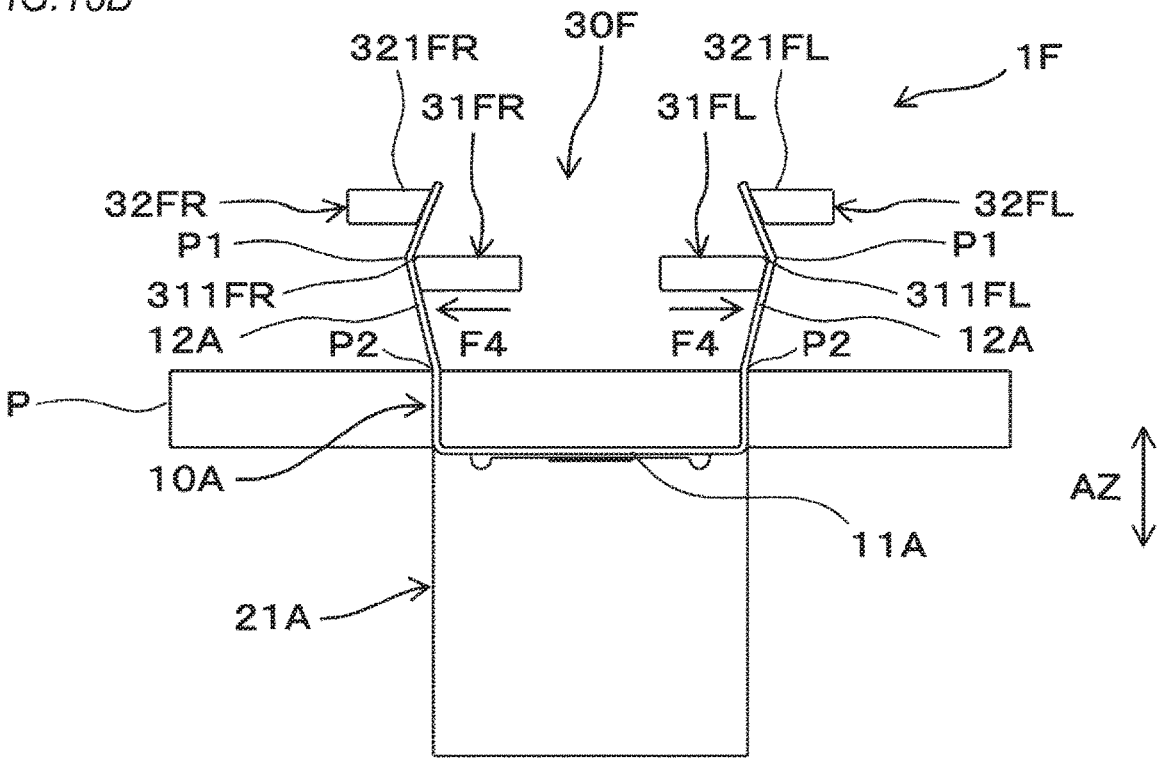
FIG. 15B is a configuration view illustrating the modified example of the stapler of the exemplary embodiment.

FIGS. 15A and 15B are configuration views illustrating a modified example of the stapler of the exemplary embodiment. An overall configuration of a stapler 1F is equivalent to the configuration shown in FIGS. 2A, 2B and 2C. The stapler 1F includes a bending part 30F configured to bend the staple legs 12A at the first position P1 such that the tips of the staple legs 12A having penetrated the sheet bundle P are directed inwardly.

The bending part 30F includes a receiving part 32FL on the outer side of one staple leg 12A, and a receiving part 32FR on the outer side of the other staple leg 12A. Also, the stapler 1F includes a movable member 31FL on the inner side of one staple leg 12A, and a movable member 31FR on the inner side of the other staple leg 12A.

The movable members 31FR and 31FL are an example of the first part. The movable member 31FL is configured to move toward and away from the receiving part 32FL, and the movable member 311R is configured to move toward and away from the receiving part 32FR. The movable member 31FL has an operating portion 311FL at an end portion configured to move toward and away from the receiving part 32FL. The operating portion 311FL is an example of the first tip portion, and a portion thereof, which faces the inner surface of one staple leg 12A having penetrated the sheet bundle P, is configured as an apex of a convex portion protruding in an acute angle shape. The movable member 31FR has an operating portion 311FR at an end portion configured to move toward and away from the receiving part 32FR. The operating portion 311FR is an example of the first tip portion, and a portion thereof, which faces the inner surface of the other staple leg 12A having penetrated the sheet bundle P, is configured as an apex of a convex portion protruding in an acute angle shape.

The receiving parts 32FL and 32FR are an example of the second part. The receiving part 32FL has an operated portion 321FL at an end portion facing the movable member 31FL. The operated portion 321FL is an example of the second tip portion, and a portion thereof, which faces the outer surface of one staple leg 12A having penetrated the sheet bundle P, is configured as an apex of a convex portion protruding in an acute angle shape. The receiving part 32FR has an operated portion 321FR at an end portion facing the movable member 31FR. The operated portion 321FR is an example of the second tip portion, and a portion thereof, which faces the outer surface of the other staple leg 12A having penetrated the sheet bundle P, is configured as an apex of a convex portion protruding in an acute angle shape.

In the arrow AZ direction, the receiving part 32FL is provided on a further upper side than the movable member 31FL, and the operated portion 321FL of the receiving part 32FL is provided on a further upper side than the operating portion 311FL of the movable member 31FL. Also, in the arrow AZ direction, the receiving part 32FR is provided on a further upper side than the movable member 31FR, and the operated portion 321FR of the receiving part 32FR is provided on a further upper side than the operating portion 311FR of the movable member 31FR.

FIG. 15A illustrates a state where the movable members 31FL and 31FR are moved to the standby position. In the state where the movable members 31FL and 31FR are moved to the standby position, the movable member 31FL forms a predetermined gap between the operating portion 311FL and the operated portion 321FL of the receiving part 32FL. Also, the movable member 31FR forms a predetermined gap between the operating portion 311FR and the operated portion 321FR of the receiving part 32FR.

The staple legs 12A of the staple 10A struck out with the striking member 21A penetrate the sheet bundle P, in which one staple leg 12A passes between the operating portion 311FL and the operated portion 321FL and the other staple leg 12A passes between the operating portion 311FR and the operated portion 321FR.

FIG. 15B illustrates a state where the movable members 31FL and 31FR are moved to the bending end position. In the state where the movable members 31FL and 31FR are moved to the bending end position, the movable member 31FL is moved to a position in which the operating portion 311FL passes the operated portion 321FL. Also, the movable member 31FR is moved to a position in which the operating portion 311FR passes the operated portion 321FR.

As shown with an arrow F4 in FIGS. 15A and 15B, while the movable member 31FL moves from the standby position toward the bending end position, the operating portion 311FL of the movable member 31FL contacts the inner surface of one staple leg 12A. The operating portion 311FL contacts the staple leg 12A at the apex of the convex portion protruding in an acute angle shape. Also, the outer surface of one staple leg 12A contacts the operated portion 321FL of the receiving part 32FL. The operated portion 321FL contacts the staple leg 12A at the apex of the convex portion protruding in an acute angle shape.

While the movable member 31FR moves from the standby position toward the bending end position, the operating portion 3111R of the movable member 31FR contacts the inner surface of the other staple leg 12A. The operating portion 311FR contacts the staple leg 12A at the apex of the convex portion protruding in an acute angle shape. Also, the outer surface of the other staple leg 12A contacts the operated portion 321FR of the receiving part 321R. The operated portion 321FR contacts the staple leg 12A at the apex of the convex portion protruding in an acute angle shape.

Thereby, force of pushing outwardly the portions of the pair of staple legs 12A protruding from the sheet bundle P is applied from the respective inner sides of the pair of staple legs 12A, so that the pair of staple legs 12A is respectively bent outwardly at the second position P2 of the staple legs 12A located closer to the sheet bundle P than the first position P1 on the upper surface of the sheet bundle P as a support point of the bending. Also, since one staple leg 12A is in contact with the operated portion 321FL on the outer side of the tip thereof, the further tip side than the first position P1 is bent inwardly by using the operating portion 311FL as a support point and the portion in contact with the operating portion 311FL as the first position P1. Since the other staple leg 12A is in contact with the operated portion 321FR on the outer side of the tip thereof, the further tip side than the first position P1 is bent inwardly by using the operating portion 311FR as a support point and the portion in contact with the operating portion 311FR as the first position P1. The operation of bending the entire staple legs 12A from the second position P2 is similar to that shown in FIGS. 8C, 8D, 9C, 9D, 10C and 10D.

The invention claimed is:

1. A stapler comprising:

a striking part configured to cause a pair of staple legs to penetrate a sheet bundle;

a bending part configured to bend the staple legs at a first position such that tips of the staple legs having penetrated the sheet bundle by the striking part are directed inwardly; and a clincher part configured to bend the staple legs at a second position located closer to the sheet bundle than the first position such that the staple legs of which the tips are bent inwardly at the first position by the bending part are entirely directed inwardly, wherein the bending part includes:

a first part disposed on an inner side of the pair of staple legs and having a first tip portion facing the staple legs and located at the first position;

a second part disposed on an outer side of the pair of staple legs and having a second tip portion facing the staple legs and located on a non-sheet bundle side spaced from the sheet bundle farther than the first position; and a moving part configured to move at least one of the first part and the second part toward the staple legs, wherein the first part further includes a first operated portion that protrudes on the non-sheet bundle side farther than the first tip portion such that the first operated portion is above the first tip portion, and wherein the first tip portion protrudes toward the staple legs farther than the first operated portion.

2. The stapler according to claim 1, wherein the moving part is configured to move the second part toward the staple legs.

3. The stapler according to claim 2, wherein the first part is a fixed cutter including a first cutting edge located on the non-sheet bundle side, wherein the second part is a movable cutter including a second cutting edge provided at a portion of the second tip portion, wherein the second part is configured to cut the staple legs by the first cutting edge and the second cutting edge by moving toward the staple legs, and wherein the first tip portion protrudes toward the staple legs farther than the first cutting edge.

4. The stapler according to claim 1, wherein the first tip portion includes an inclined portion inclined such that a thickness thereof becomes smaller toward a tip thereof.

5. The stapler according to claim 3, wherein the first tip portion and the first cutting edge are disposed such that an angle between an extension line of a virtual line connecting the second position and the first tip portion and an extension line of a virtual line connecting the first tip portion and the first cutting edge is 15° or greater.

6. The stapler according to claim 3, wherein the first tip portion and the first cutting edge are disposed such that a length of a virtual line connecting the first tip portion and the first cutting edge is 3 mm or less.

7. The stapler according to claim 1, wherein the first operated portion protrudes along a first axis on the non-sheet bundle side, and the first tip portion protrudes along a second axis toward the staple legs, and wherein the second axis is perpendicular to the first axis.

8. The stapler according to claim 1, wherein the first operated portion has a first end and a second end, wherein the first end of the first operated portion is formed by a first corner portion of an upper surface of the first part and a first side surface of the first part, and wherein the second end of the first operated portion is formed by a second corner portion of the upper surface of the first part and a second side surface of the first part.

* * * * *